US011490706B2

(12) United States Patent
Nakashima et al.

(10) Patent No.: US 11,490,706 B2
(45) Date of Patent: Nov. 8, 2022

(54) NAIL TIP, NAIL TIP POSITIONING ASSISTANCE TOOL, AND NAIL TIP FOR DISPLAY PROVIDED THEREWITH

(71) Applicant: Kotaro Nakashima, Tokyo (JP)

(72) Inventors: Kotaro Nakashima, Tokyo (JP); Yukino Nakashima, Tokyo (JP)

(73) Assignee: Kotaro Nakashima, Tokyo (JP)

( * ) Notice: Subject to any disclaimer, the term of this patent is extended or adjusted under 35 U.S.C. 154(b) by 633 days.

(21) Appl. No.: 15/571,975

(22) PCT Filed: May 9, 2016

(86) PCT No.: PCT/JP2016/063714
§ 371 (c)(1),
(2) Date: Nov. 6, 2017

(87) PCT Pub. No.: WO2016/181925
PCT Pub. Date: Nov. 17, 2016

(65) Prior Publication Data

US 2018/0116366 A1 May 3, 2018

(30) Foreign Application Priority Data

May 8, 2015 (WO) ..... PCT/JP2015/063309
Jul. 7, 2015 (WO) ..... PCT/JP2015/069477

(51) Int. Cl.
*A45D 29/20* (2006.01)
*A47F 7/00* (2006.01)
*A45D 31/00* (2006.01)

(52) U.S. Cl.
CPC ..... *A45D 29/20* (2013.01); *A45D 31/00* (2013.01); *A47F 7/00* (2013.01)

(58) Field of Classification Search
CPC ..... A45D 29/00; A45D 29/001; A45D 29/20; A45D 31/00; A45D 2031/005;
(Continued)

(56) References Cited

U.S. PATENT DOCUMENTS 2,417,677 A * 3/1947 Cohan ..... G09F 5/042 434/100
3,485,344 A 12/1969 Aylott
(Continued)

FOREIGN PATENT DOCUMENTS

FR 1481773 * 6/1966
FR 2 271 788 A1 12/1975
(Continued)

OTHER PUBLICATIONS

FR 1,481,773 computer translation (Year: 1966).*
(Continued)

*Primary Examiner* — Rachel R Steitz
(74) *Attorney, Agent, or Firm* — Maier & Maier, PLLC

(57) ABSTRACT

An object of the present invention is to provide a display nail tip suitable for being arranged, as samples of nail tips for nail art to be provided to customers, in a hard case, frames, boards, pedestals or the like and being presented to the customers or displayed in shops. Another object of the present invention is to provide a nail tip for the display nail tip described above and a nail tip positioning assistance tool. A display nail tip of the present invention includes a nail body (1) and a nail tip positioning assistance tool (14*a*, 14*b*) for assisting arrangement of the nail body on a nail tip display tool. The nail tip positioning assistance tool is integral-molded with any one of a thickness portion (3) of the nail body, a thick peripheral edge (1*h*) of the nail body, a concavely curved surface (1*b*) of the nail body, a base portion (4) arranged on the concavely curved surface (1*b*) of the nail body and a convexly curved surface (1*a*) of the nail body.

12 Claims, 24 Drawing Sheets

(58) Field of Classification Search
CPC ... A45D 2200/052; A45D 44/005; A47F 7/00; G09B 1/00; G09B 19/0076
USPC ..... 434/100
See application file for complete search history.

(56) References Cited

U.S. PATENT DOCUMENTS

| | | | | |
|---|---|---|---|---|
| 4,696,316 | A | 9/1987 | Stanley | |
| 5,904,149 | A * | 5/1999 | Ruhl | A45D 31/00 132/73 |
| 6,354,447 | B1 | 3/2002 | Brown | |
| 6,901,934 | B1 | 6/2005 | Tran | |
| 8,343,067 | B2 * | 1/2013 | Jones | A61B 3/113 600/558 |
| 2006/0006092 | A1 * | 1/2006 | DuBos | A45D 29/00 206/575 |
| 2008/0289646 | A1 * | 11/2008 | Fracassi | A45D 31/00 132/200 |

FOREIGN PATENT DOCUMENTS

| | | | |
|---|---|---|---|
| GB | 1125910 | A | 9/1968 |
| JP | S58-185111 | U | 12/1983 |
| JP | S59-39922 | Y2 | 11/1984 |
| JP | 2004-313634 | A | 11/2004 |
| JP | 2004344595 | A | 12/2004 |
| JP | 2006-55508 | A | 3/2006 |
| JP | 2008-029652 | A | 2/2008 |
| JP | 3189544 | U | 3/2014 |

OTHER PUBLICATIONS

Extended European Search Report dated Feb. 20, 2018, in connection with counterpart EP Application No. 16792650.0 (8 pgs.).
International Search Report dated Aug. 9, 2016 of corresponding International application No. PCT/JP2016/063714; 2 pgs.
Russian Office Action dated Oct. 14, 2019, in connection with corresponding RU Application No. 2017139925/12 (069420) (16 pgs., including machine-generated English translation).

* cited by examiner

NAIL TIP, NAIL TIP POSITIONING ASSISTANCE TOOL, AND NAIL TIP FOR DISPLAY PROVIDED THEREWITH

TECHNICAL FIELD

The present invention relates to a sample of a nail tip relating to nail art provided to customers.

BACKGROUND ART

In recent years, nail art to apply design to nails of hands and feet is prevalent. Manicurist who is a nail art professional presents customers with nail tips with various designs. The customer selects a favorite design from among them. The manicurist applies nail art to the customer's nails.

Originally, a nail tip was designed as a tip imitating a human nail. The nail tip was born as a so-called "artificial nail" for attaching the tip with a design to a fingertip. Even now, many manicurists really recognize that the nail tip is made of the "artificial nail" as a base material.

As a use of the nail art becomes popular and the number of nail salons increase, the nail tips used in an actual nail art treatment are more often used as samples to show designs to customers and exhibits for the designs in the nail salons than used as an original purpose of the "artificial nails".

When the nail art is provided to the customer, many manicurists use a nail tip sample set which includes conventional nail tips 26 shown in FIG. 25(*a*) with designs arranged in a resin hard case, a frame, a board, a pedestal or the like, as design samples or showpieces.

In a conventional nail tip sample set, the nail tips 26 shown in FIG. 25(*a*) are arranged on a nail tip display tool such as a cork board, a resin pedestal, a hard case, a frame, or the like. The nail tips 26 with various designs are arranged on the nail tip display tool 25 with an adhesive tape (e.g., a double-sided tape) on a concave-curved back surface 26*a* or a peripheral edge 26*b* thereof.

In the case where the nail tip display tool 25 is a resin hard case, the nail tip sample set is configured of the hard case having many nail tips 26 arranged on a sponge or cotton material therein by a double-sided tape, closed with a transparent lid material. Since it is necessary to display a lot of the designed nail tips 26 to customers at the same time, the nail tips 26 in the conventional nail tip sample set are arranged with no gap therebetween.

PRIOR ART DOCUMENT

Patent Literature

Patent Document 1: Japanese Utility Model Registration No. 3189544

Patent Document 2: Japanese Patent Publication No. 2004-344595

SUMMARY OF THE INVENTION

Problem to be Solved by Invention

In the conventional nail tip sample set, the nail tips 26 are just attached on the sponge or cotton material in the hard case by the double-sided tape. Thus, the nail tips 26 are easily detached with a slight impact, and the arrangement of the nail tips 26 is often broken as shown in FIG. 25(*b*). The nail tip sample set 24 in such a state is not good in appearance in showing it to customers.

In addition, when one or more nail tips 26 are replaced in the state where the nail tips 26 are arranged well, well-arranged other nail tips 26 may be detached from the sponge or cotton material by vibration caused by removing the one or more nail tips displayed from the sponge or cotton material in the hard case, resulting in braking the arrangement of them.

Furthermore, when a nail tip for the nail art is attached to or detached from the customer's nail, dust resulting from filing the nail tip or the customer's nail may adhere to a double-faced tape surface to which the nail tip display tool 25 is attached. Such a nail tip sample set is also not good in appearance in showing it to the customers.

Since the conventional nail tips 26 have not been developed as a sample for the display, the conventional nail tip sample set is not suitable for the presentation to the customers or the display samples of showpieces in the nail salons.

However, since the conventional nail tips 26 are manufactured on the basis of shapes of human nails, there are not so many methods to display the nail tips 26 on the nail tip display tool. Thus, the manicurist had only to use the conventional nail tip sample set 24 produced by the above-described method.

In view of the above, an object of the present invention is to provide a display nail tip suitable for being arranged, as samples of nail tips for nail art to be provided to customers, in hard cases, frames, boards, pedestals or the like and being presented to the customers or displayed in shops.

Another object of the present invention is to provide a nail tip for the display nail tip described above and a nail tip positioning assistance tool.

Means for Solving the Problem

The invention of claim 1 is a nail tip includes:

(1) a nail body; and (2) an attachment for attaching the nail body to a nail tip positioning assistance tool for assisting arrangement of the nail body on a nail tip display tool, (3) wherein the attachment is arranged on any one of:

(a) a thickness portion of the nail body;

(b) a thick peripheral edge of the nail body;

(c) a concavely curved surface of the nail body;

(d) a base portion arranged on the concavely curved surface of the nail body; and (e) a convexly curved surface of the nail body.

The invention of claim 6 is a nail tip positioning assistance tool for assisting arrangement of a nail body on a nail tip display tool, including (1) an attachment assistance body, (2) wherein one end of the attachment assistance body is attached to any one of:

(a) a thickness portion of the nail body;

(b) a thick peripheral edge of the nail body;

(c) a concavely curved surface of the nail body;

(d) a base portion arranged on the concavely curved surface of the nail body; and (e) a convexly curved surface of the nail body, (3) wherein the other end of the attachment assistance body includes an attachment for an attaching assistance member to be attached thereto; and wherein the attaching assistance member includes one or more members selected from the group consisting of a needle-like member, rod-like member, plate-like member, columnar member, cylindrical member, spherical member, conic member, pyramid member, adhesive member, magnet member, adsorption member, and hook member or loop member of hook and loop fastener.

The invention of claim 9 is a nail tip positioning assistance tool for assisting arrangement of a nail body to a nail tip display tool, including:

(1) an attachment assistance body; and (2) an attaching assistance member to be attached to the attachment assistance body.

The invention of claim 19 is a display nail tip including:

(1) a nail body; and (2) a nail tip positioning assistance tool for assisting arrangement of the nail body on a nail tip display tool, (3) wherein the nail tip positioning assistance tool is integral-molded with any one of:

(a) a thickness portion of the nail body;

(b) a thick peripheral edge of the nail body;

(c) a concavely curved surface of the nail body;

(d) a base portion arranged on the concavely curved surface of the nail body; and (e) a convexly curved surface of the nail body, (4) the nail body is arranged on the nail tip display tool such that:

(a) one end of the nail tip positioning assistance tool is attached to or contacted with the nail tip display tool, and then the nail body is set close to the nail tip display tool; or (b) said one end of the nail tip positioning assistance tool is attached to or contacted with the nail tip display tool, and then a front end portion, a rear end portion or side end portions of the nail body 1 is contacted with the nail tip display tool.

The invention of claim 20 is a display nail tip including:

(1) a nail body; and (2) a nail tip positioning assistance tool for assisting arrangement of the nail body on a nail tip display tool; and (3) an attachment for attaching the nail body to one end of the nail tip positioning assistance tool, (4) wherein the attachment is arranged on any one of:

(a) a thickness portion of the nail body;

(b) a thick peripheral edge of the nail body;

(c) a concavely curved surface of the nail body;

(d) a base portion arranged on the concavely curved surface of the nail body; and (e) a convexly curved surface of the nail body (5) the nail body is arranged on the nail tip display tool such that:

(a) the other end of the nail tip positioning assistance tool is attached to or contacted with the nail tip display tool, and then the nail body is set close to the nail tip display tool; or (b) the other end of the nail tip positioning assistance tool is attached to or contacted with the nail tip display tool, and then a front end portion, a rear end portion or side end portions of the nail body 1 is contacted with the nail tip display tool.

Effect of the Invention

According to the present invention, it is possible to provide a display nail tip suitable for being arranged, as samples of nail tips for nail art to be provided to customers, in hard cases, frames, boards, pedestals or the like and presented to customers or displayed in shops.

Another object of the present invention is to provide a nail tip for the display nail tip described above and a nail tip positioning assistance tool.

BRIEF DESCRIPTION OF THE DRAWINGS

FIG. 2(*b*) shows a rear view, side view and bottom view in order from left, for an example of a nail tip according to the present invention.

FIG. 2(*c*) shows a rear view, side view and bottom view in order from left, for an example of a nail tip according to the present invention.

FIG. 2(*d*) shows a rear view, side view and bottom view in order from left, for an example of a nail tip according to the present invention.

FIG. 3(*b*) shows a rear view, side view and bottom view in order from left, for another example of a nail tip according to the present invention.

FIG. 3(*c*) shows a rear view, side view and bottom view in order from left, for another example of a nail tip according to the present invention.

FIG. 3(*d*) shows a rear view, side view and bottom view in order from left, for another example of a nail tip according to the present invention.

FIG. 4(*b*) shows a rear view, side view and bottom view in order from left, for an example of a state in which an attachment is arranged on the nail tip shown in FIG. 2.

FIG. 4(*c*) shows a rear view, side view and bottom view in order from left, for an example of a state in which an attachment is arranged on the nail tip shown in FIG. 2.

FIG. 4(*d*) shows a rear view, side view and bottom view in order from left, for an example of a state in which an attachment is arranged on the nail tip shown in FIG. 2.

FIG. 5(*b*) shows a rear view, side view and bottom view in order from left, for another example of a state in which an attachment is arranged on the nail tip shown in FIG. 3.

FIG. 5(*c*) shows a rear view, side view and bottom view in order from left, for another example of a state in which an attachment is arranged on the nail tip shown in FIG. 3.

FIG. 5(*d*) shows a rear view, side view and bottom view in order from left, for another example of a state in which an attachment is arranged on the nail tip shown in FIG. 3.

FIG. 6(*b*) shows a side view and bottom view in order from left, for another example of an attachment provided in the nail tip according to the present invention.

FIG. 6(*c*) shows a side view and bottom view in order from left, for another example of an attachment provided in the nail tip according to the present invention.

FIG. 7(*b*) shows a side view and bottom view in order from left, for yet another example of an attachment provided in the nail tip according to the present invention.

FIG. 7(*c*) shows a side view and bottom view in order from left, for yet another example of an attachment provided in the nail tip according to the present invention.

FIG. 8(*b*) shows a side view and bottom view in order from left, for yet another example of an attachment provided in the nail tip according to the present invention.

FIG. 8(*c*) shows a side view and bottom view in order from left, for yet another example of an attachment provided in the nail tip according to the present invention.

FIG. 10(*b*) shows an example of a nail tip positioning assistance tool according to the present invention.

FIG. 10(*c*) shows an example of a nail tip positioning assistance tool according to the present invention.

FIG. 11(*b*) shows another example of a nail tip positioning assistance tool according to the present invention.

FIG. 11(*c*) shows another example of a nail tip positioning assistance tool according to the present invention.

FIG. 11(*d*) shows another example of a nail tip positioning assistance tool according to the present invention.

FIG. 11(*e*) shows another example of a nail tip positioning assistance tool according to the present invention.

FIG. 11(*f*) shows another example of a nail tip positioning assistance tool according to the present invention.

FIG. 11(*g*) shows another example of a nail tip positioning assistance tool according to the present invention.

FIG. 12(*b*) shows yet another example of a nail tip positioning assistance tool according to the present invention.

FIG. 12(*c*) shows yet another example of a nail tip positioning assistance tool according to the present invention.

FIG. 12(*d*) shows yet another example of a nail tip positioning assistance tool according to the present invention.

FIG. 12(*e*) shows yet another example of a nail tip positioning assistance tool according to the present invention.

FIG. 12(*f*) shows yet another example of a nail tip positioning assistance tool according to the present invention.

FIG. 12(*g*) shows yet another example of a nail tip positioning assistance tool according to the present invention.

FIG. 13 (*b*) shows a rear view, side view and bottom view in order from left, for an example of a first embodiment of a display nail tip according to the present invention.

FIG. 13 (*c*) shows a rear view, side view and bottom view in order from left, for an example of a first embodiment of a display nail tip according to the present invention.

FIG. 13 (*d*) shows a rear view, side view and bottom view in order from left, for an example of a first embodiment of a display nail tip according to the present invention.

FIG. 14 (*b*) shows a rear view, side view and bottom view in order from left, for another example of the display nail tip according to the first embodiment.

FIG. 14 (*c*) shows a rear view, side view and bottom view in order from left, for another example of the display nail tip according to the first embodiment.

FIG. 14 (*d*) shows a rear view, side view and bottom view in order from left, for another example of the display nail tip according to the first embodiment.

FIG. 15 (*b*) shows a rear view, side view and bottom view in order from left, for yet another example of the display nail tip according to the first embodiment.

FIG. 15 (*c*) shows a rear view, side view and bottom view in order from left, for yet another example of the display nail tip according to the first embodiment.

FIG. 15 (*d*) shows a rear view, side view and bottom view in order from left, for yet another example of the display nail tip according to the first embodiment.

FIG. 16 (*b*) shows a rear view, side view and bottom view in order from left, for yet another example of the display nail tip according to the first embodiment.

FIG. 16 (*c*) shows a rear view, side view and bottom view in order from left, for yet another example of the display nail tip according to the first embodiment.

FIG. 16 (*d*) shows a rear view, side view and bottom view in order from left, for yet another example of the display nail tip according to the first embodiment.

FIG. 18 (*b*) shows a rear view, side view and bottom view in order from left, for yet another example of the display nail tip according to the first embodiment.

FIG. 18 (*c*) shows a rear view, side view and bottom view in order from left, for yet another example of the display nail tip according to the first embodiment.

FIG. 18 (*d*) shows a rear view, side view and bottom view in order from left, for yet another example of the display nail tip according to the first embodiment.

FIG. 19 (*b*) shows a rear view, side view and bottom view in order from left, for yet another example of the display nail tip according to the first embodiment.

FIG. 20 (*b*) shows an example of a use state of the display nail tip according to the first embodiment.

FIG. 20 (*c*) shows an example of a use state of the display nail tip according to the first embodiment.

FIG. 20 (*d*) shows an example of a use state of the display nail tip according to the first embodiment.

FIG. 21 (*b*) shows a side view, top view and bottom view in order from left, for an example of a second embodiment of a display nail tip according to the present invention.

FIG. 21 (*c*) shows a side view, bottom view and rear view in order from left, for an example of a second embodiment of a display nail tip according to the present invention.

FIG. 22 (*b*) shows an example of a use state of the display nail tip according to the second embodiment.

FIG. 22 (*c*) shows an example of a use state of the display nail tip according to the second embodiment.

FIG. 22 (*d*) shows an example of a use state of the display nail tip according to the second embodiment.

FIG. 23 (*b*) shows a top view of a third embodiment of a display nail tip according to the present invention.

FIG. 23 (*c*) shows a rear view of a third embodiment of a display nail tip according to the present invention.

FIG. 23 (*d*) shows a top view of a third embodiment of a display nail tip according to the present invention.

FIG. 23 (*e*) shows a view for explaining a state of adjusting an attaching angle of a nail body to a nail tip display tool.

FIG. 24 (*b*) shows an example of a use state of the display nail tip according to the third embodiment.

FIG. 24 (*c*) shows an example of a use state of the display nail tip according to the third embodiment.

FIG. 24 (*d*) shows an example of a use state of the display nail tip according to the third embodiment.

FIG. 24 (*e*) shows an example of a use state of the display nail tip according to the third embodiment.

FIG. 25 (*b*) shows a view of a conventional nail tip sample set.

DESCRIPTION OF THE EMBODIMENTS

Figure 1A:
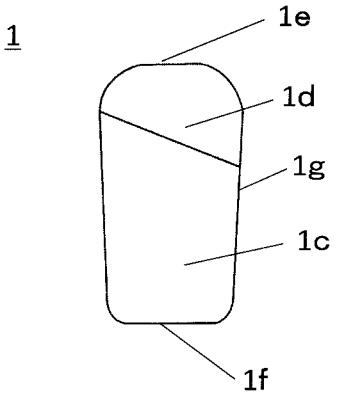
FIGS. 1(*a*) to 1(*d*) shows a front, rear, side and bottom views showing an example of a nail body according to the present invention, respectively.
Figure 1B:
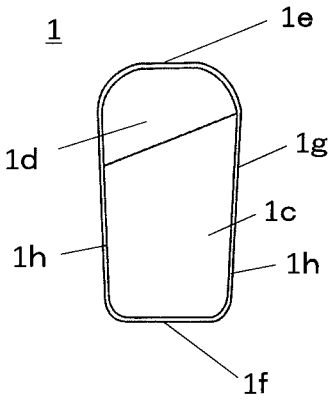
Figure 1C:
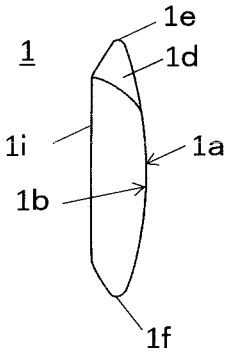
Figure 1D:
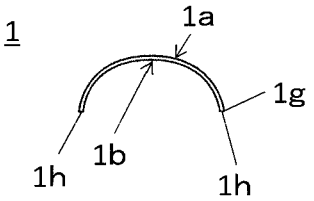
Figure 2A:
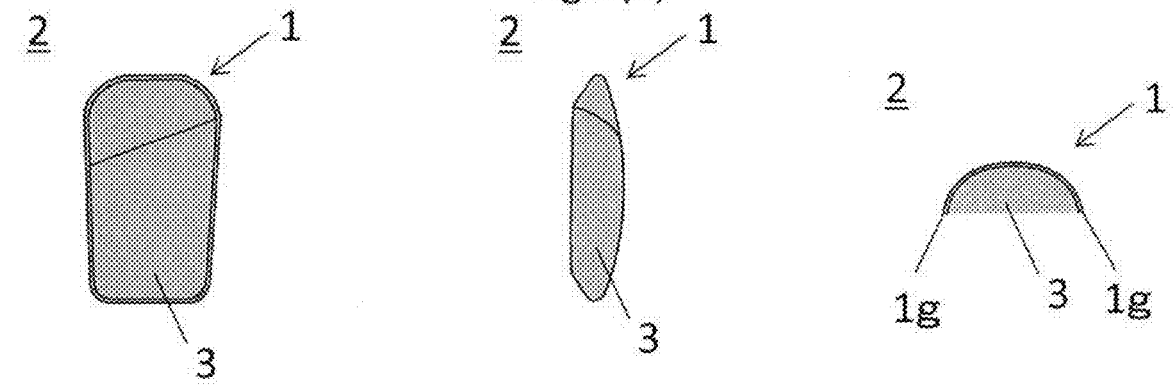
FIG. 2(*a*) shows a rear view, side view and bottom view in order from left, for an example of a nail tip according to the present invention.
Figure 2B:
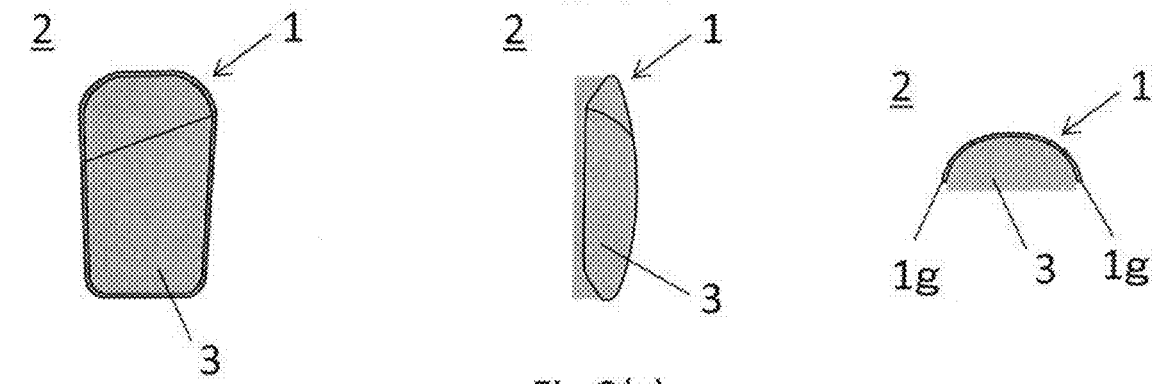
Figure 2C:
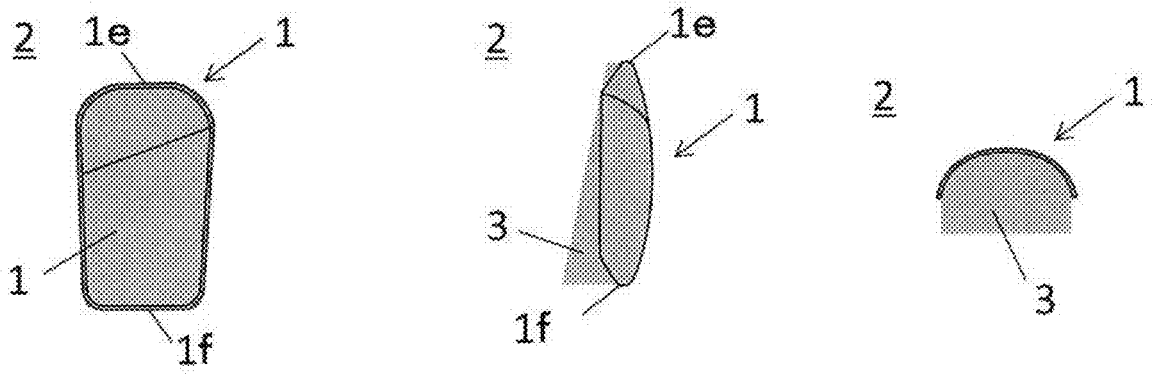
Figure 2D:
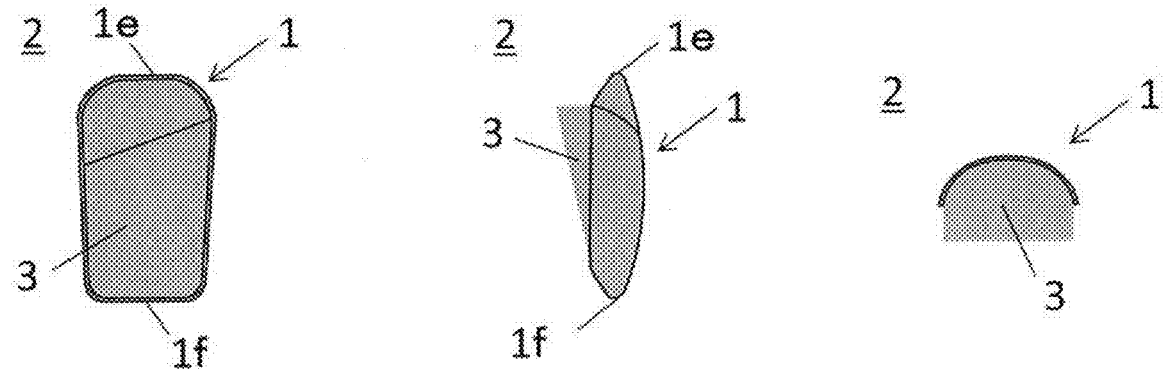
Figure 3A:
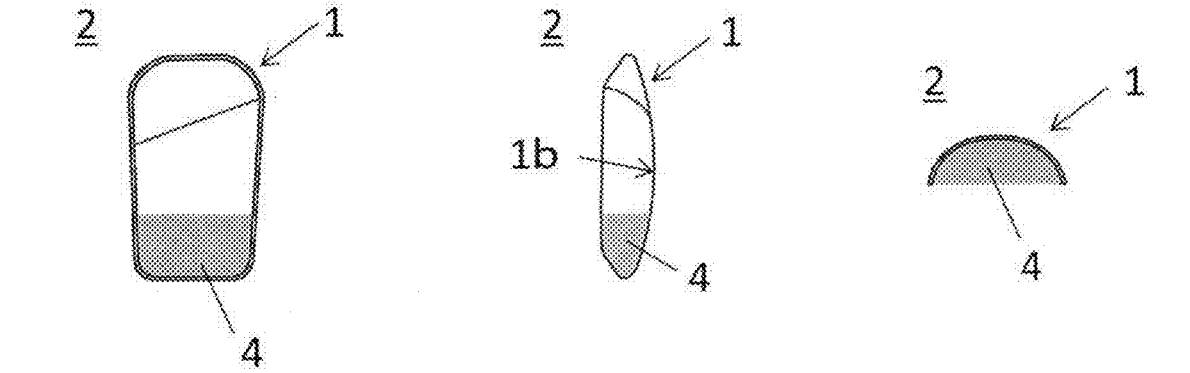
FIG. 3(*a*) shows a rear view, side view and bottom view in order from left, for another example of a nail tip according to the present invention.
Figure 3B:
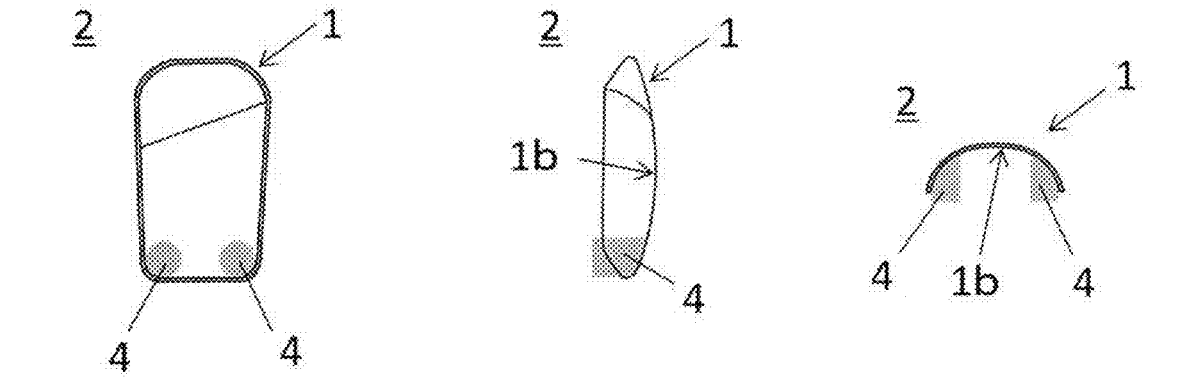
Figure 3C:
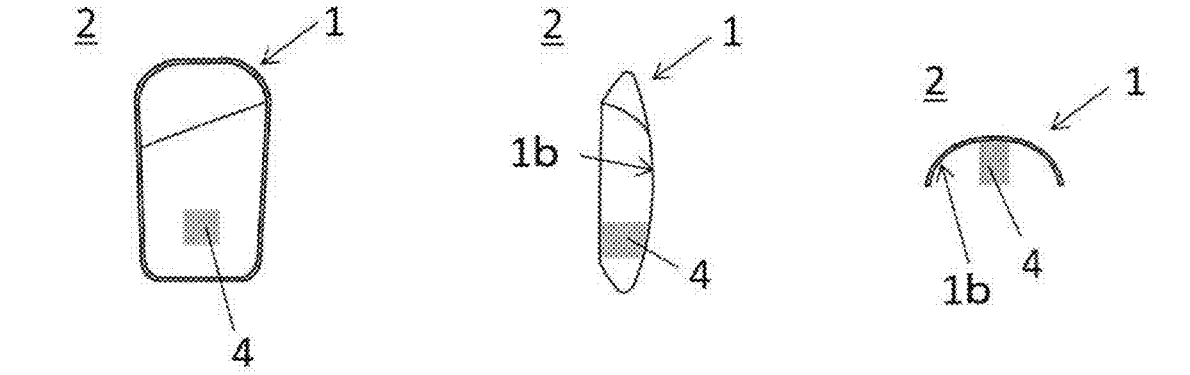
Figure 3D:
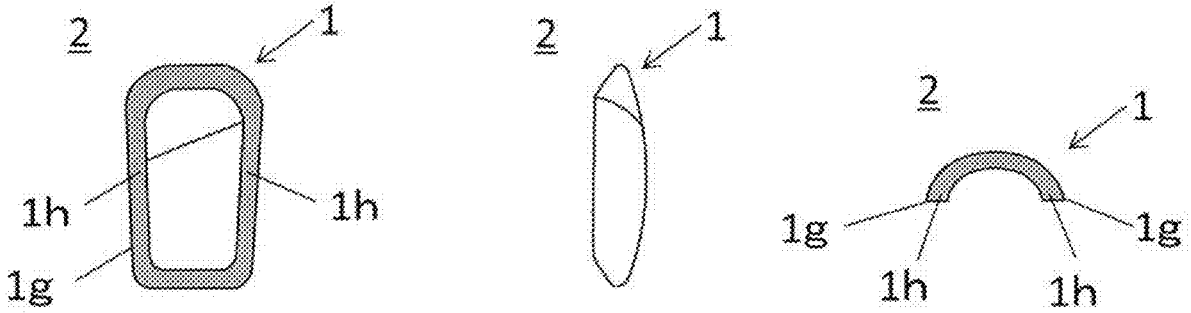
Figure 4A:
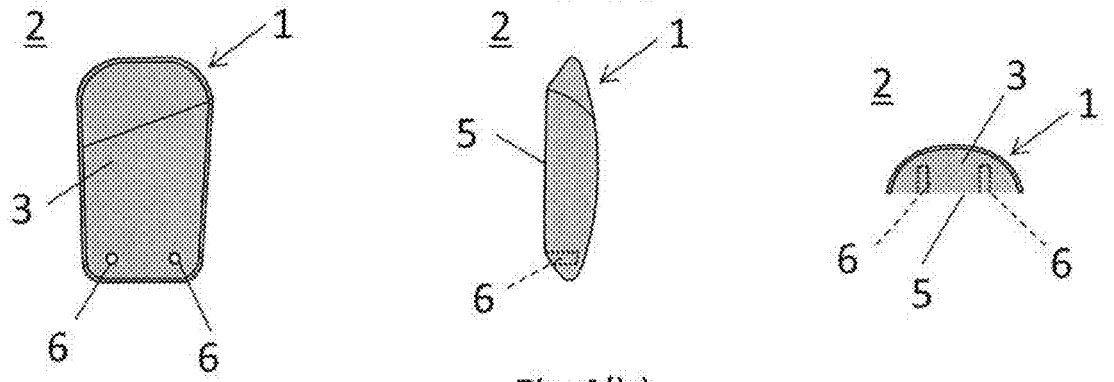
FIG. 4(*a*) shows a rear view, side view and bottom view in order from left, for an example of a state in which an attachment is arranged on the nail tip shown in FIG. 2.
Figure 4B:
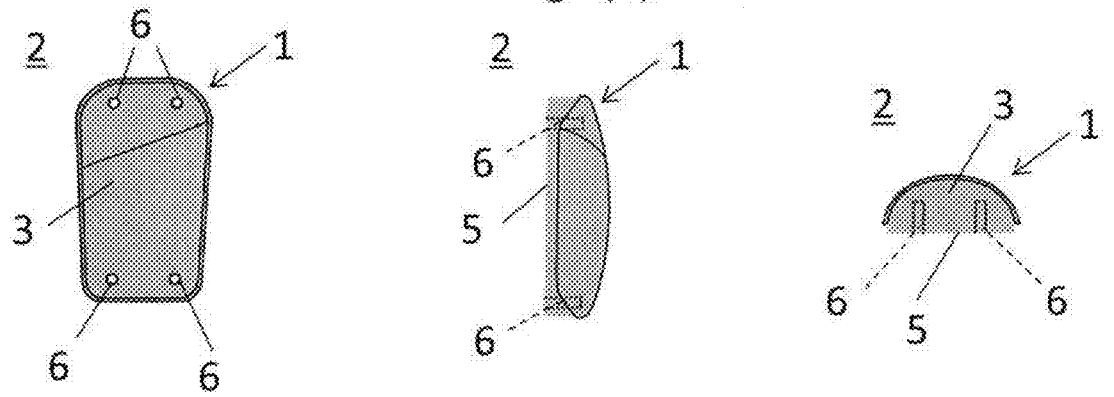
Figure 4C:
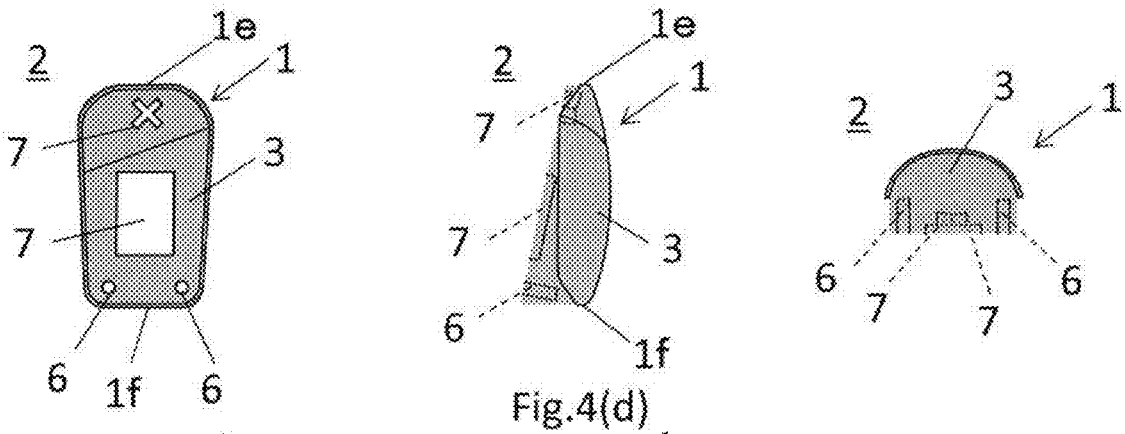
Figure 4D:
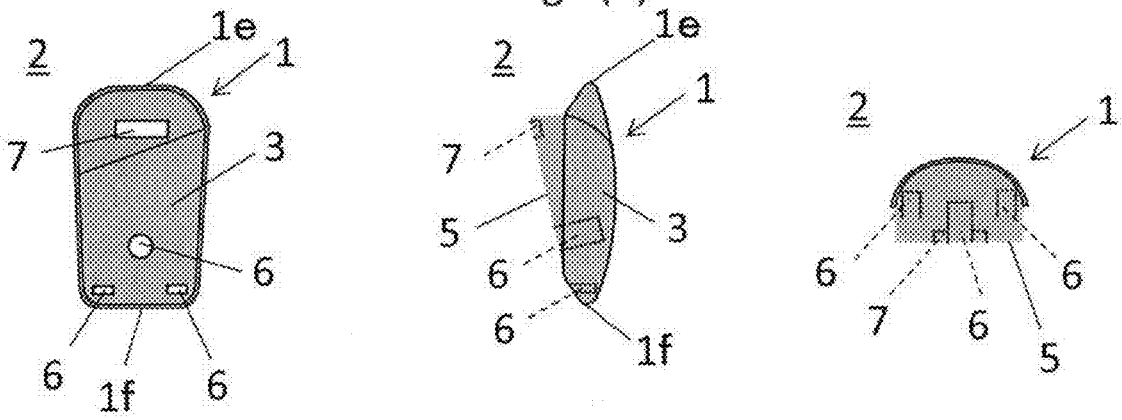
Figure 5A:
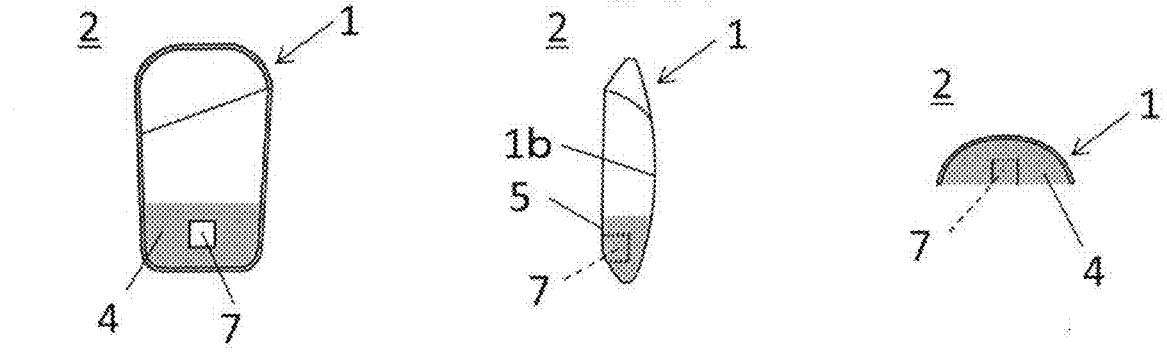
FIG. 5(*a*) shows a rear view, side view and bottom view in order from left, for another example of a state in which an attachment is arranged on the nail tip shown in FIG. 3.
Figure 5B:
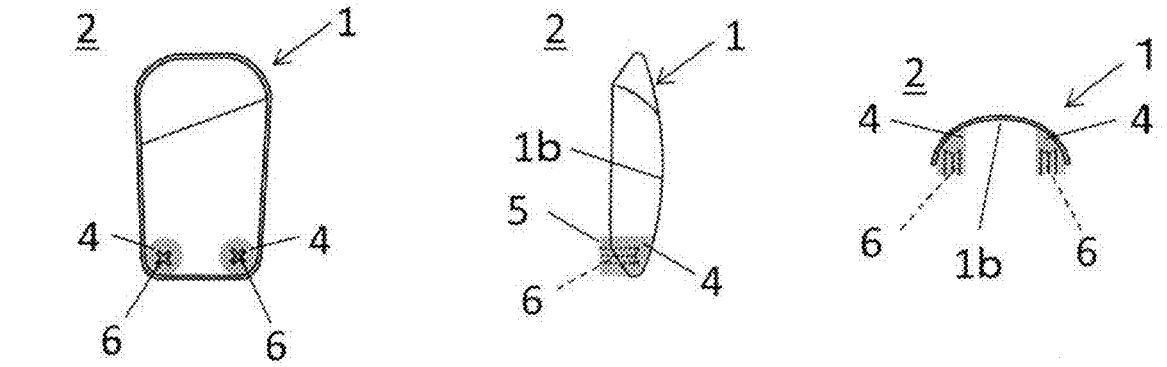
Figure 5C:
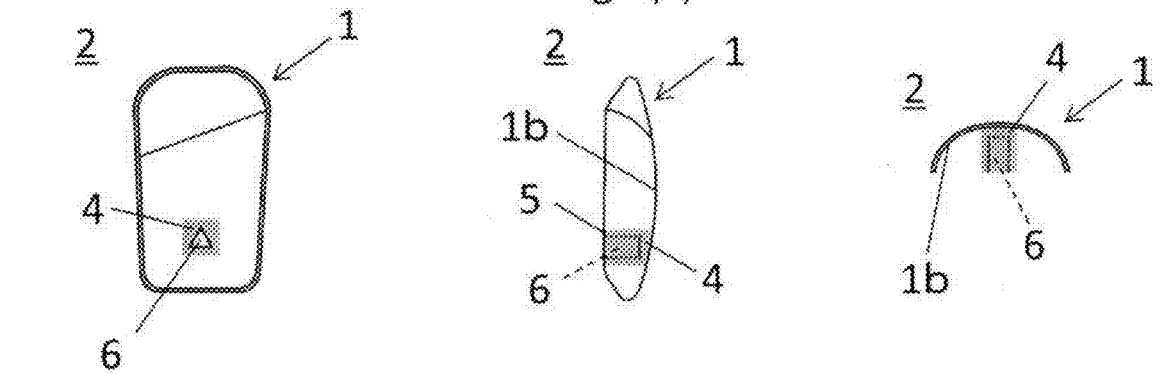
Figure 5D:
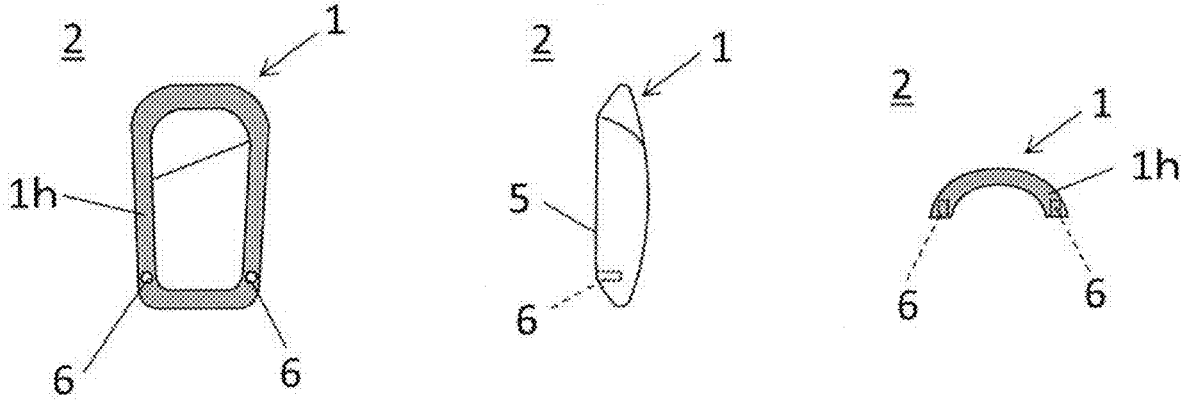

Embodiments of the present invention will be described with reference to the accompanying drawings. The configuration of a nail body common to each embodiment will be described with reference to FIG. 1.

The nail body 1 illustrated is a transparent resin tip, and has various designs applied to a convexly curved surface 1*a*. In an illustrated example, the surface of the nail body 1 is divided into a decorative surface 1*c* with any designs and a transparent non-decorative surface 1*d* without any designs.

When a nail tip for nail art related to the nail body 1 is attached to a nail of a customer, a portion of the nail tip for nail art corresponding to a base end portion 1*e* (rear end portion) of the nail body 1 corresponds to at an attaching portion to the nail, and a portion of the nail tip for the nail art corresponding to a front end portion 1*f* corresponds to a portion on a fingertip side.

A concavely curved surface 1*b* of the nail body 1 is a back surface of the nail body 1. In addition, a portion corresponding to a predetermined thickness of a peripheral edge 1*g* of the nail body 1 is referred to a thick peripheral edge 1*h*. Further, left and right edge portions of the nail body are referred to respective side end portions 1*i*.

In the embodiments of the present invention, the same reference numerals will be referred to the same elements of the above-described nail body 1, and description thereof will be omitted.

[Embodiment of Nail Tip]

Embodiments of the nail tips according to the present invention will be described with reference to FIGS. 2 to 9.

Each of the nail tips in the present embodiments include the nail body 1 and an attachment for attaching the nail body 1 to a nail tip positioning assistance tool for arranging the nail body 1 on a nail tip display tool such as a hard case, frame, board and pedestal.

The nail tip in the embodiment can have, as examples, various shapes as shown in FIGS. 2 and 3.

In a nail tip 2 shown in FIG. 2 (*a*), a thickness portion 3 which is an increased thickness part in the nail body 1 is formed with the peripheral edge 1*g* of the nail body 1 at the same level.

In a nail tip 2 shown in FIG. 2 (*b*), a thickness portion 3 is arranged so as to go beyond a surface surrounding the peripheral edge 1*g* of the nail body.

In a nail tip 2 shown in FIG. 2(*c*), a thickness portion 3 is arranged so that a thickness of the base end portion 1*f* of the nail body is thicker than that of the front end portion 1*e* of the nail body. In a nail tip 2 shown in FIG. 2(*d*), a thickness portion 3 is arranged so that the thickness of the base end portion 1*e* of the nail body is thicker than that of the front end portion 1*f* of the nail body.

In a nail tip 2 shown in each of FIGS. 3(*a*) to 3(*c*), a base portion 4 is arranged on the concavely curved surface 1*b*. It is sufficient that a shape of the base portion 4 protrudes so as to have a predetermined length from the concavely curved surface 1*b*. In addition to illustrated examples, the base portion 4 may have a rod shape, a cylindrical shape, or the like.

In a nail tip 2 shown in FIG. 3 (*d*), the thick peripheral edge 1*h* is thicker.

As shown in FIGS. 4 to 8, the attachment according to the present embodiment is arranged on any one of:

(1) the thickness portion 3 of the nail body 1;
(2) the thick peripheral edge 1*h* of the nail body 1;
(3) the concavely curved surface 1*b* of the nail body 1;
(4) the base portion 4 arranged on the concavely curved surface 1*b* of the nail body 1; and
(5) the convexly curved surface 1*a* of the nail body 1.

In addition, as shown in FIGS. 4 to 8, the attachment according to the present embodiment includes any one of:

(1) a flat portion 5 for one end of the nail tip positioning assistance tool to be attached thereto;
(2) a projecting portion 8 or a recessed portion 7 for one end of the nail tip positioning assistance tool to be attached thereto;
(3) a hole 6 for one end of the nail tip positioning assistance tool to be inserted or screwed therein; and
(4) an engaged portion to be engaged with an engaging portion arranged on one end of the nail tip positioning assistance tool.

In a nail tip 2 shown in FIG. 4(*a*), the thickness portion 3 of the nail body 1 shown in FIG. 2(*a*) has the flat portion 5 and holes 6. In a nail tip 2 shown in FIG. 4(*b*), the thickness portion 3 of the nail body 1 shown in FIG. 2(*b*) has the flat portion 5 and holes 6. In a nail tip 2 shown in FIG. 4(*c*), the thickness portion 3 of the nail body 1 shown in FIG. 2(*c*) has the holes 6 and recessed portions 7. In a nail tip 2 shown in FIG. 4(*d*), the thickness portion 3 of the nail body 1 shown in FIG. 2(*d*) has the flat portion 5, holes 6 and recessed portion 7.

In a nail tip 2 shown in FIG. 5(*a*), the base portion 4 arranged on the concavely curved surface 1*b* of the nail body 1 shown in FIG. 3(*a*) has the flat portion 5 and recessed portion 7. In a nail tip 2 shown in FIG. 5(*b*), the base portions 4 arranged on the concavely curved surface 1*b* of the nail body 1 shown in FIG. 3(*b*) has the flat portion 5 and holes 6. In a nail tip 2 shown in FIG. 5(*c*), the base portion 4 arranged on the concavely curved surface 1*b* of the nail body 1 shown in FIG. 3(*c*) has the flat portion 5 and hole 6.

In a nail tip 2 shown in FIG. 5(*d*), the thick peripheral edge 1*h* of the peripheral edge of the nail body 1 shown in FIG. 3(*d*) has the flat portion 5 and holes 6.

Figure 6A:
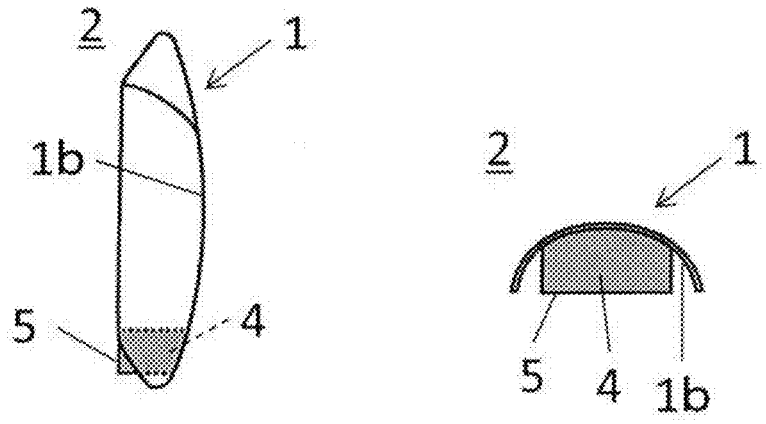
FIG. 6(*a*) shows a side view and bottom view in order from left, for another example of an attachment provided in the nail tip according to the present invention.
Figure 6B:
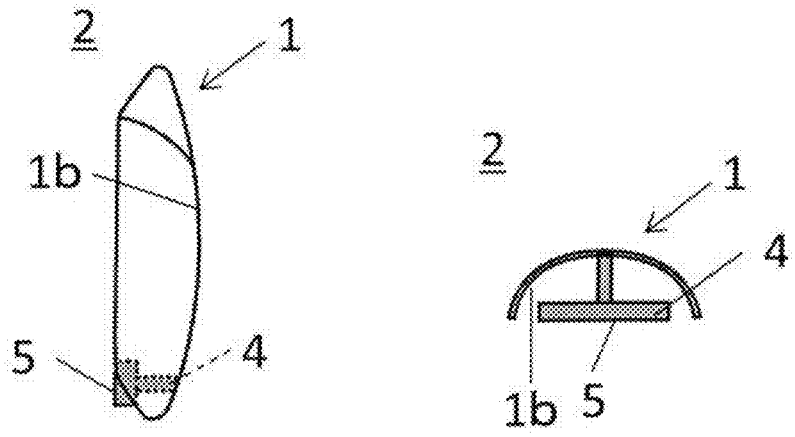
Figure 6C:
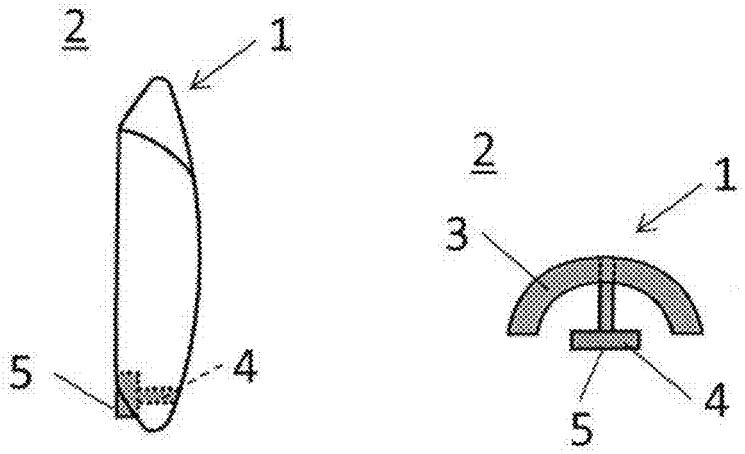

In a nail tip 2 shown in each of FIGS. 6(*a*) and 6(*b*), the base portion 4 arranged on the concavely curved surface 1*b* of the nail body 1 has the flat portion 5.

In a nail tip 2 shown in FIG. 6(*c*), the base portion 4 arranged on the thickness portion 3 of the nail body has the flat portion 5.

Figure 7A:
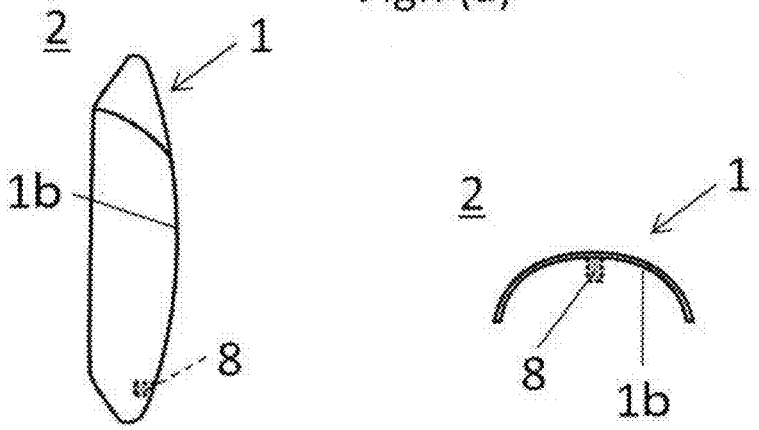
FIG. 7(*a*) shows a side view and bottom view in order from left, for yet another example of an attachment provided in the nail tip according to the present invention.
Figure 7B:
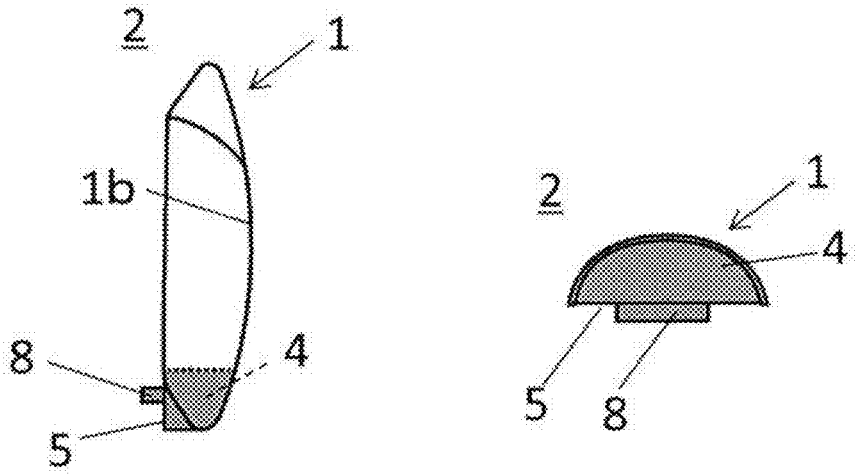
Figure 7C:
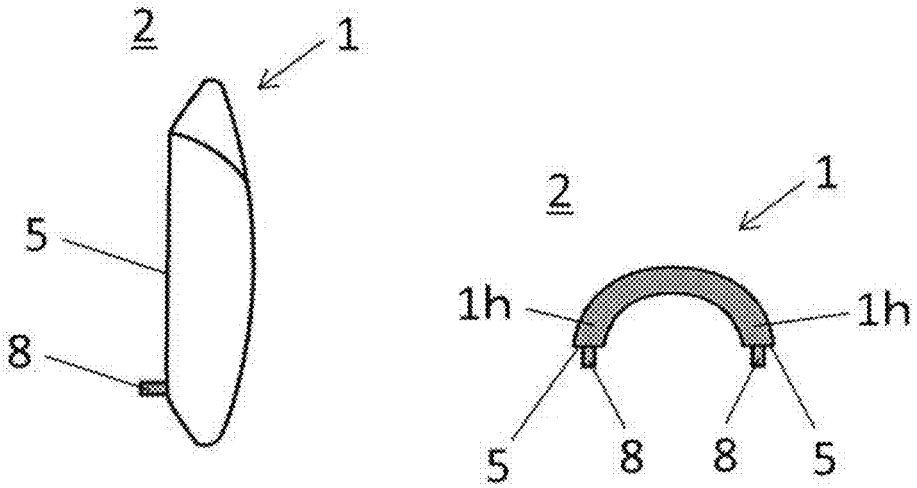

In a nail tip 2 shown in FIG. 7(*a*), the concavely curved surface 1*b* of the nail body 1 has the projecting portion 8.

In a nail tip 2 shown in FIG. 7(*b*), the base portion 4 arranged on the concavely curved surface 1*b* of the nail body 1 has the flat portion 5 and the projecting portion 8.

In a nail tip 2 shown in FIG. 7(*c*), the thick peripheral edge 1*h* of the peripheral edge of the nail body 1 has the flat portion 5 and the projecting portion 8.

An inner surface of the hole(s) 6 shown in each of FIGS. 4 and 5 may have a female screw portion. In addition, an outer surface of the projecting portion 8 shown in FIG. 7 may have a male screw portion.

Figure 8A:
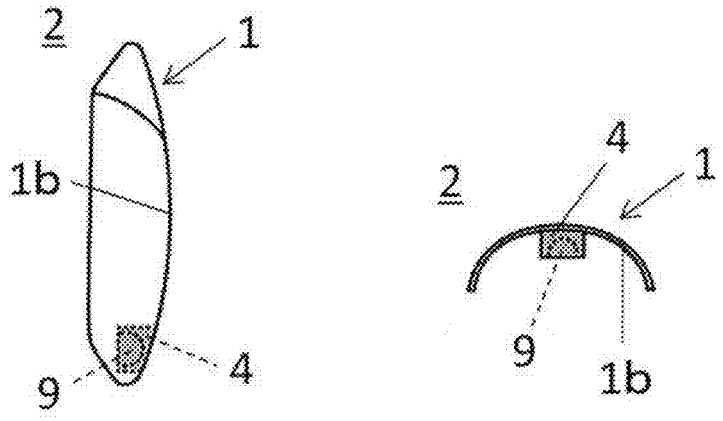
FIG. 8(*a*) shows a side view and bottom view in order from left, for yet another example of an attachment provided in the nail tip according to the present invention.
Figure 8B:
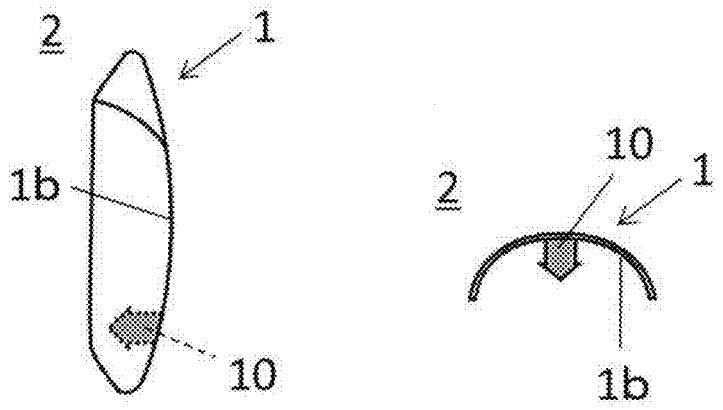
Figure 8C:
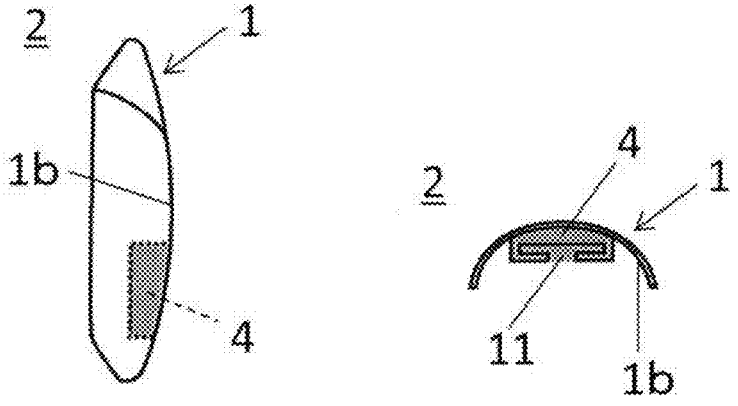
Figure 9A:
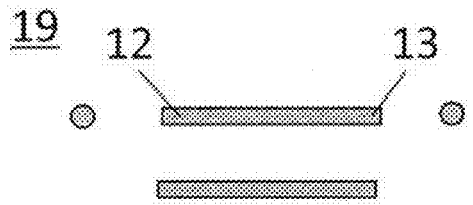
FIGS. 9(*a*) to (*i*) show left side views, front views, right side views and top views in order from left, for various examples of attaching assistance members according to the present invention.
Figure 9B:
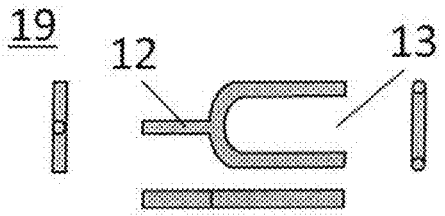
Figure 9C:
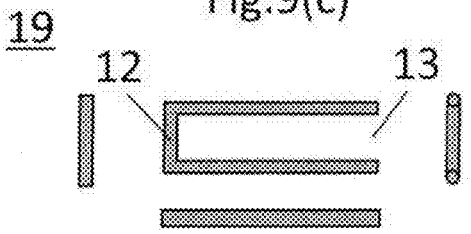
Figure 9D:
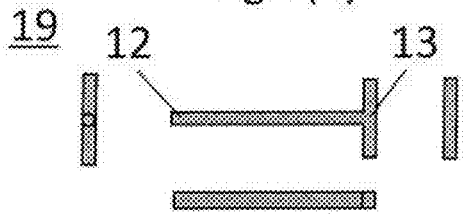
Figure 9E:
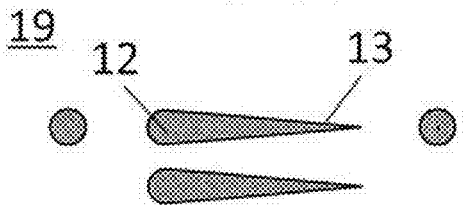
Figure 9F:
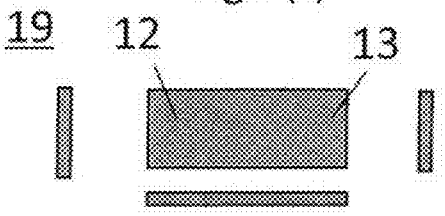
Figure 9G:
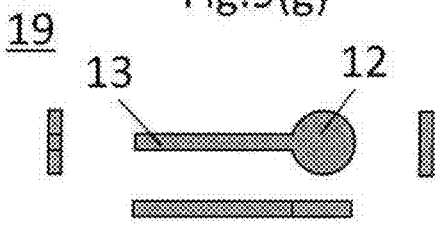
Figure 9H:
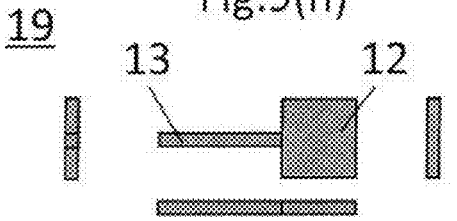
Figure 9I:
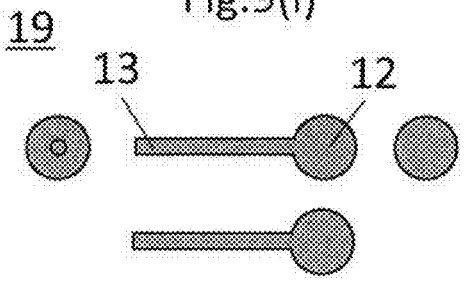
Figure 9J:
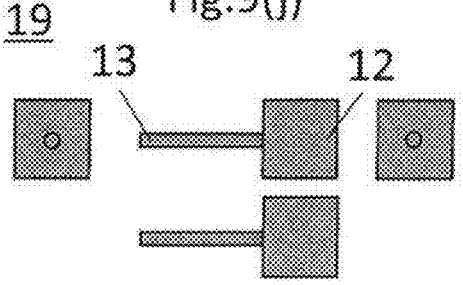

In the embodiment shown in FIG. 8, the engaged portion to be engaged with the engaging portion arranged on one end of the nail tip positioning assistance tool is exemplified.

In a nail tip 2 shown in FIG. 8(*a*), the base portion 4 arranged on the concavely curved surface 1*b* of the nail body 1 has a fitting recess 9 to be fitted with a fitting convex placed on one end of the nail tip positioning assistance tool.

In a nail tip 2 shown in FIG. 8 (*b*), the concavely curved surface 1*b* of the nail body 1 has an engaging projection 10 to be engaged with an annular engaging portion arranged on one end of the nail tip positioning assistance tool.

In a nail tip 2 shown in FIG. 8 (*c*), the base portion 4 arranged on the concavely curved surface 1*b* of the nail body 1 has an engaging groove 11 to be engaged with the engaging portion arranged on one end of the nail tip positioning assistance tool.

The nail tip positioning assistance tool for arranging the nail body 1 on the nail tip display tool such as a hard case, a frame, a board, a pedestal, or the like is attached to the above-described attachment of the nail tip 2 of the present embodiment.

In each embodiment of the present invention, the nail tip positioning assistance tool includes an attaching assistance member 19 including one or more members selected from the group consisting of a needle-like member, rod-like member, plate-like member, columnar member, cylindrical member, spherical member, conic member, pyramid member, adhesive member, magnet, adsorption member such as suction cup, and hook member or loop member of hook and loop fastener.

FIG. 9 shows examples of the attaching assistance member 19. A member adapted to the above-mentioned attachment included in the nail tip 2 of the present embodiment is used to the attaching assistance member 19.

With the nail tip 2 shown in each of FIGS. 4 to 6, one end 12 of each of the attaching assistance members 19 shown in FIG. 9 adapted to the corresponding flat portion 5, hole 6 or recessed portion 7 is attached to the nail tip 2 via an adhesive, a gluing agent, or the like.

With the nail tip 2 shown in FIG. 7, the projecting portion 8 is attached to the recessed portion or the hole placed on one end 12 of the attaching assistance member 19 other than the members shown in FIG. 9 adapted to the projecting portion via an adhesive, a gluing agent, or the like. In addition, when the outer surface of the projecting portion 8 shown in each of FIGS. 7(*a*) and 7(*c*) has the male screw portion, the male screw portion is screwed into the female screw portion on the one end 12 of the attaching assistance member 19.

With the nail tip 2 shown in FIG. 8(*a*), a spherical member poisoned at one end 12 of the attaching assistance member 19 as shown in FIGS. 9(*e*) and 9(*i*) adapted to the fitting recess 9 is press-fitted to the fitting recess 9.

With the nail tip 2 shown in FIG. 8(*b*), an annular engaging portion arranged on one end 12 of the attaching assistance member 19 other than the members shown in FIG. 9 adapted to the engaging projection 10 is engaged with the engaging projection 10.

With the nail tip 2 shown in FIG. 8(*c*), a plate-like member positioned at one end 12 of the attaching assistance member 19 as shown in FIGS. 9 (*f*) to 9 (*h*) adapted to the engaging groove 11 is engaged with the engaging groove 11.

In the nail tip of this embodiment, the base portion 4 shown in each of FIGS. 5(*c*), 6(*b*), and 6(*c*) and the projecting portion 8 shown in each of FIGS. 7(*a*) and 7(*c*) may be produced by using known plastic deformable materials. By using the plastic deformable materials, it is possible to arrange the nail body 1 at various angles on the nail tip display tool by adjusting an arrangement angle of the nail body 1 with respect to the nail tip display tool of the nail body 1.

In addition, by freely fitting the spherical member positioned at one end 12 of the attaching assistance member 19 as shown in FIGS. 9(*e*) and 9(*i*) to the fitting recess 9 shown in FIG. 8 (*a*), it is possible to arrange the nail body 1 to the nail tip display tool at various angles by adjusting the arrangement angle of the nail body 1 with respect to the nail tip display tool.

[Embodiment of Nail tip Positioning Assistance Tool]

First Embodiment

Figure 10A:
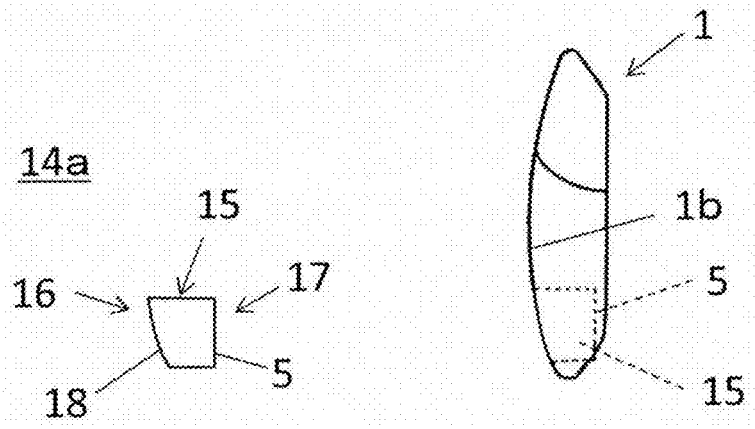
FIG. 10(*a*) shows an example of a nail tip positioning assistance tool according to the present invention.
Figure 10B:
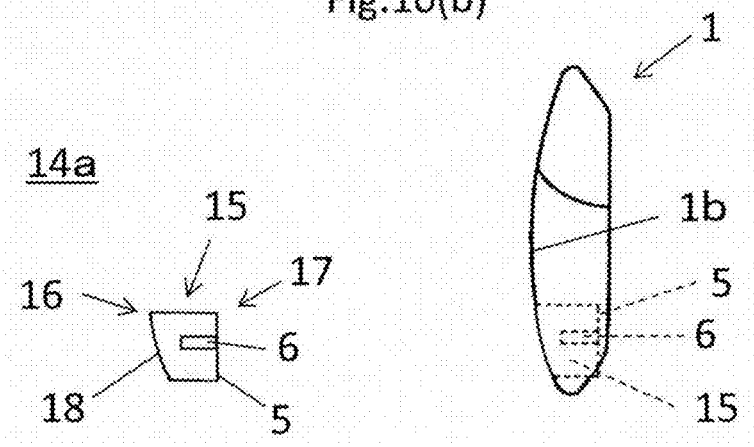
Figure 10C:
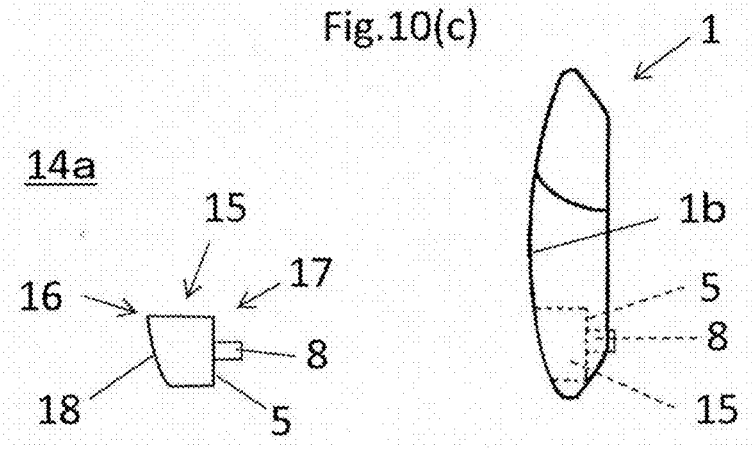
Figure 11A:
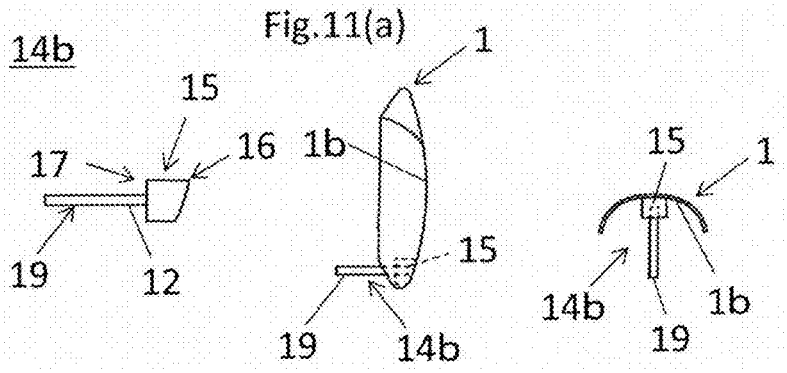
FIG. 11(*a*) shows another example of a nail tip positioning assistance tool according to the present invention.
Figure 11B:
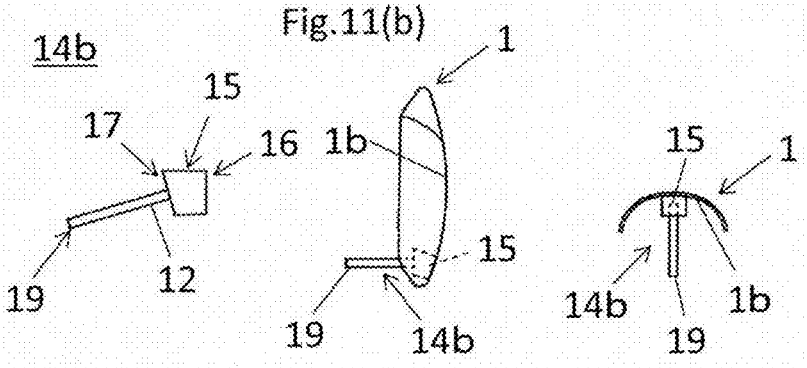
Figure 11C:
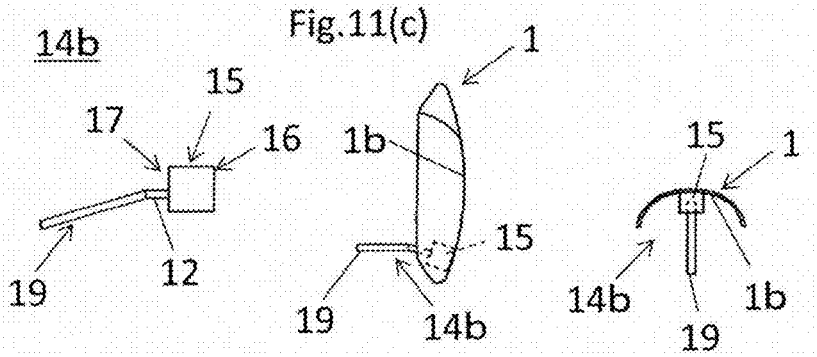
Figure 11D:
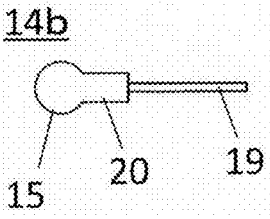
Figure 11E:
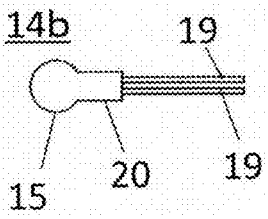
Figure 11F:
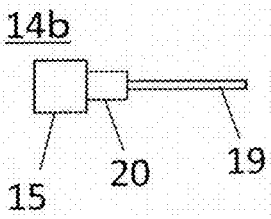
Figure 11G:
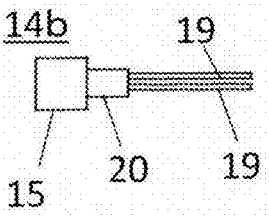
Figure 12A:
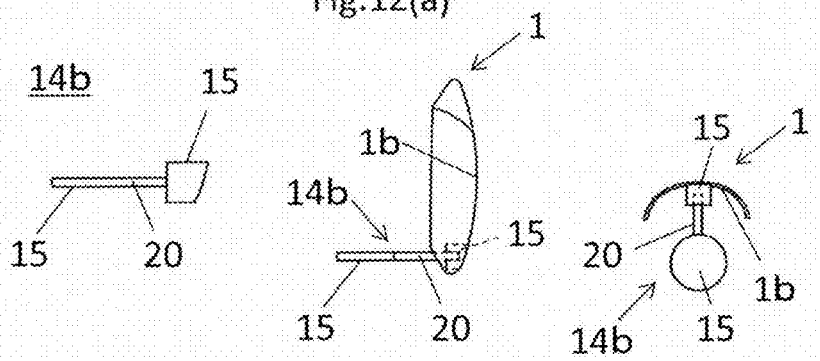
FIG. 12(*a*) shows yet another example of a nail tip positioning assistance tool according to the present invention.
Figure 12B:
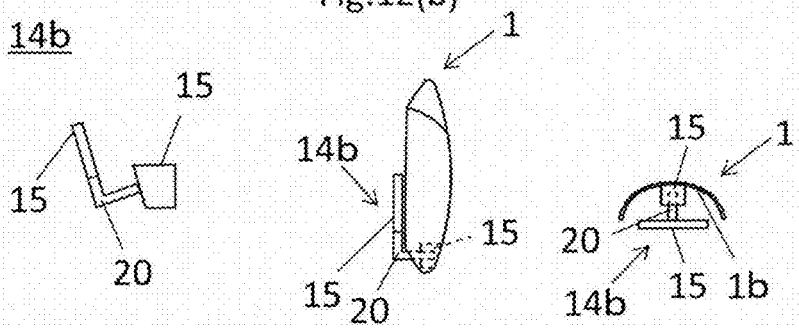
Figure 12C:
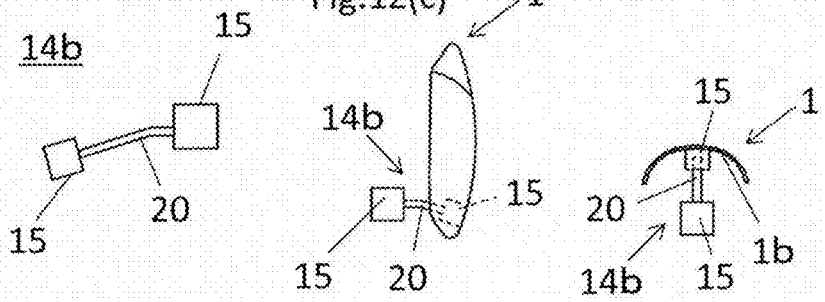
Figure 12D:
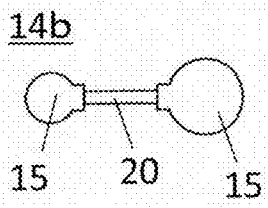
Figure 12E:
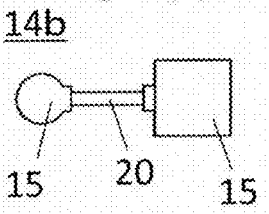
Figure 12F:
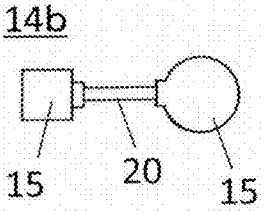
Figure 12G:
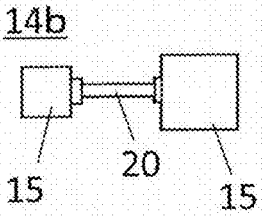
Figure 13A:
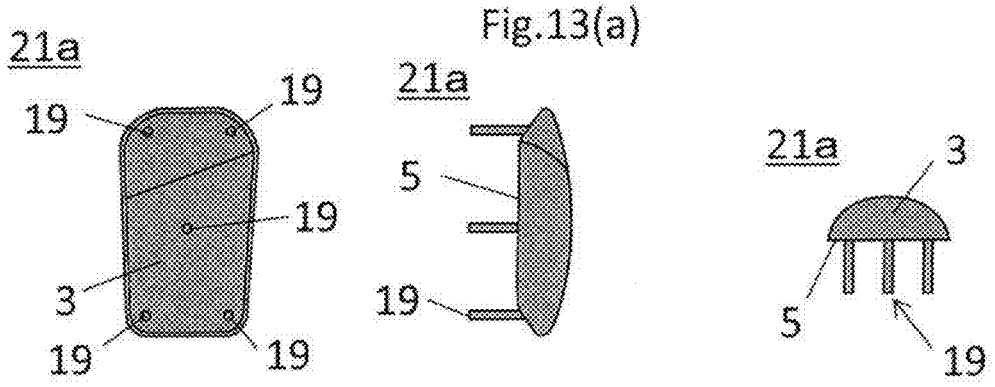
FIG. 13 (*a*) shows a rear view, side view and bottom view in order from left, for an example of a first embodiment of a display nail tip according to the present invention.
Figure 13B:
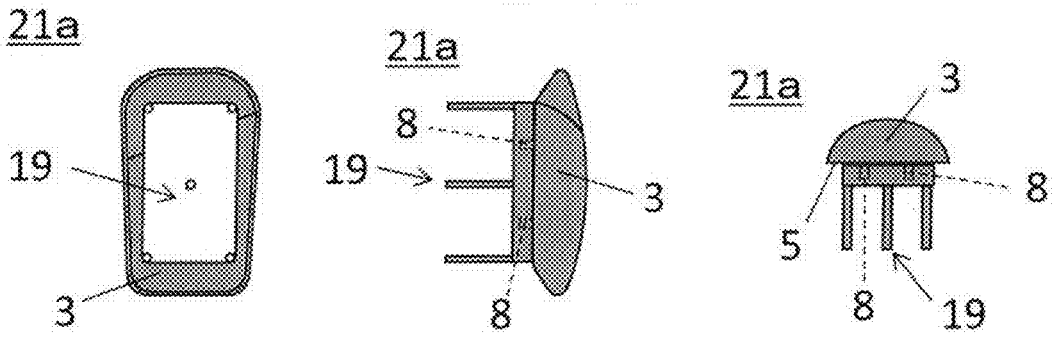
Figure 13C:
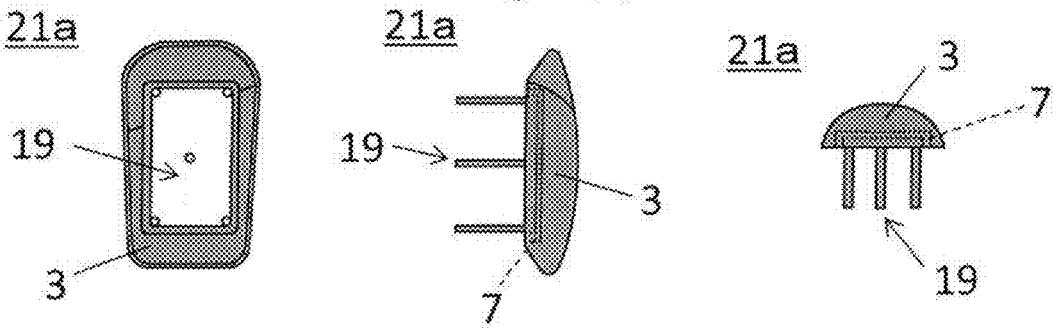
Figure 13D:
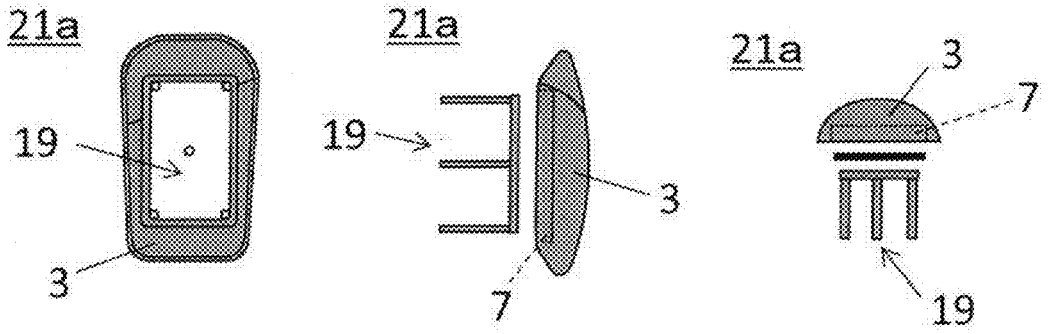
Figure 14A:
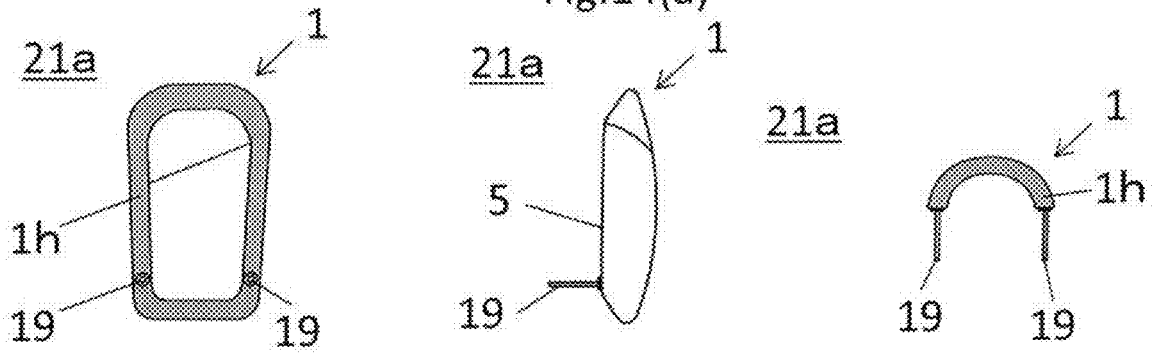
FIG. 14 (*a*) shows a rear view, side view and bottom view in order from left, for another example of the display nail tip according to the first embodiment.
Figure 14B:
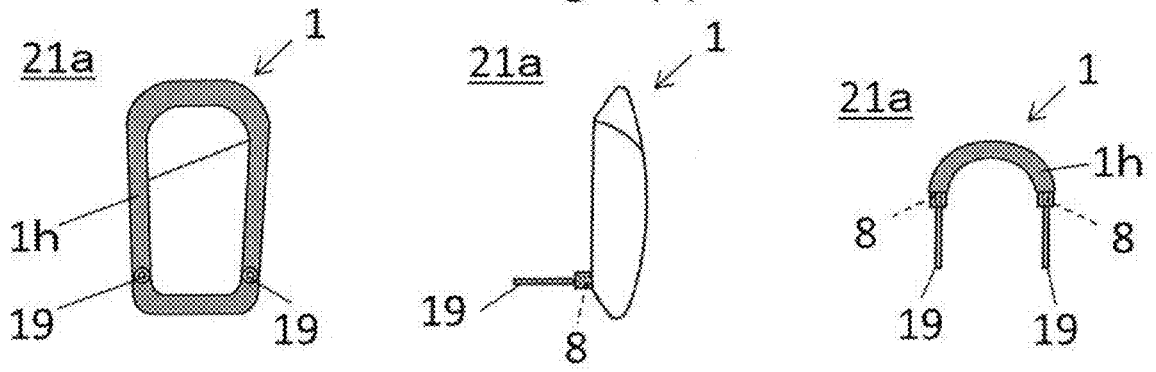
Figure 14C:
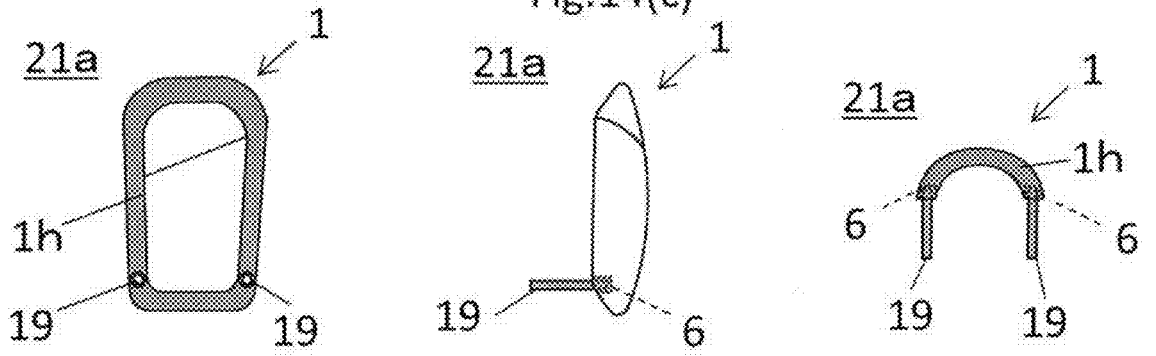
Figure 14D:
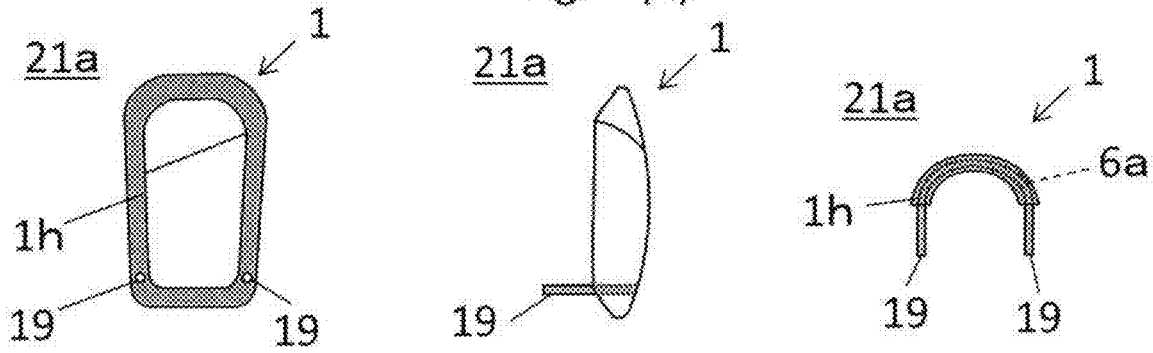
Figure 15A:
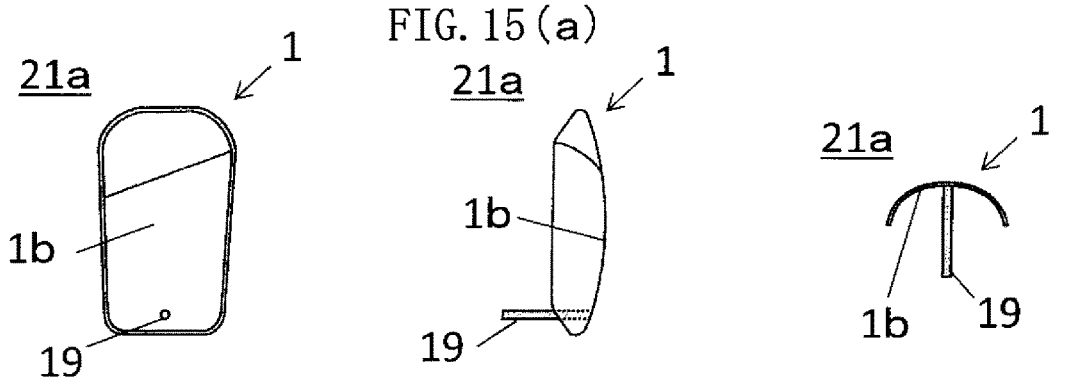
FIG. 15 (*a*) shows a rear view, side view and bottom view in order from left, for yet another example of the display nail tip according to the first embodiment.
Figure 15B:
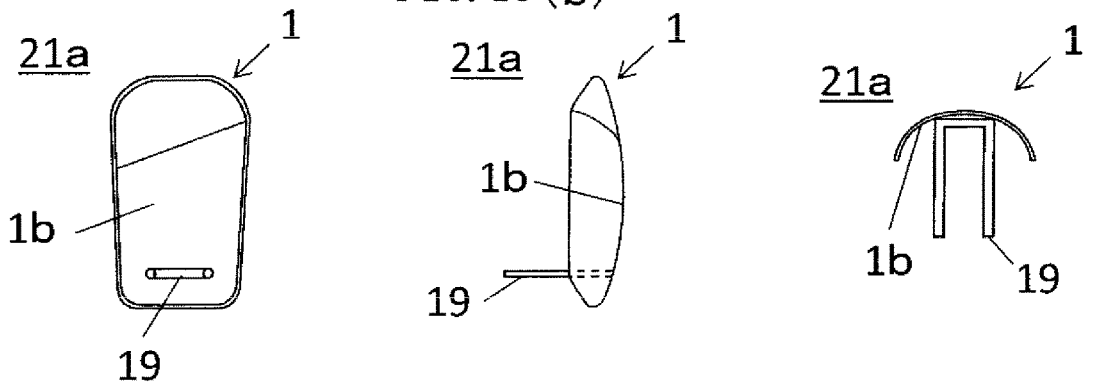
Figure 15C:
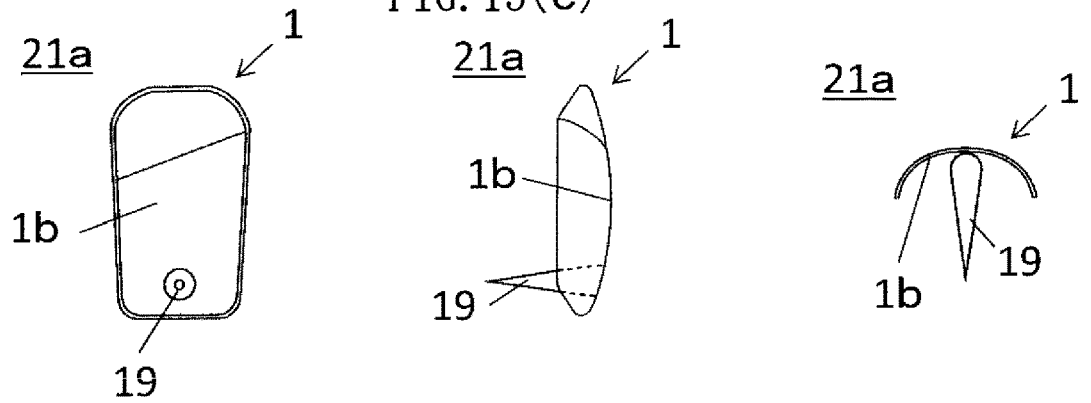
Figure 15D:
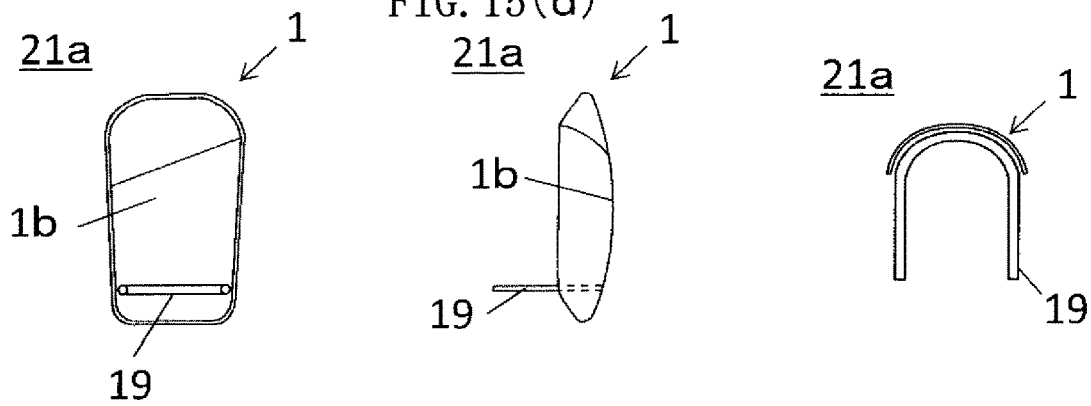
Figure 16A:
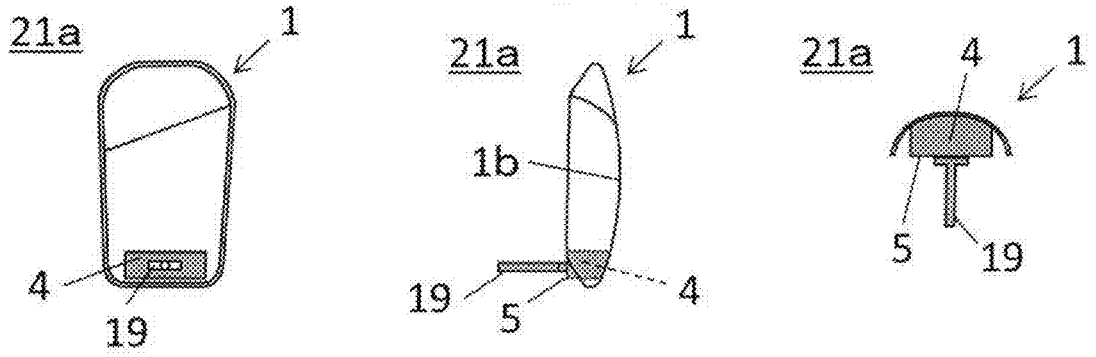
FIG. 16 (*a*) shows a rear view, side view and bottom view in order from left, for yet another example of the display nail tip according to the first embodiment.
Figure 16B:
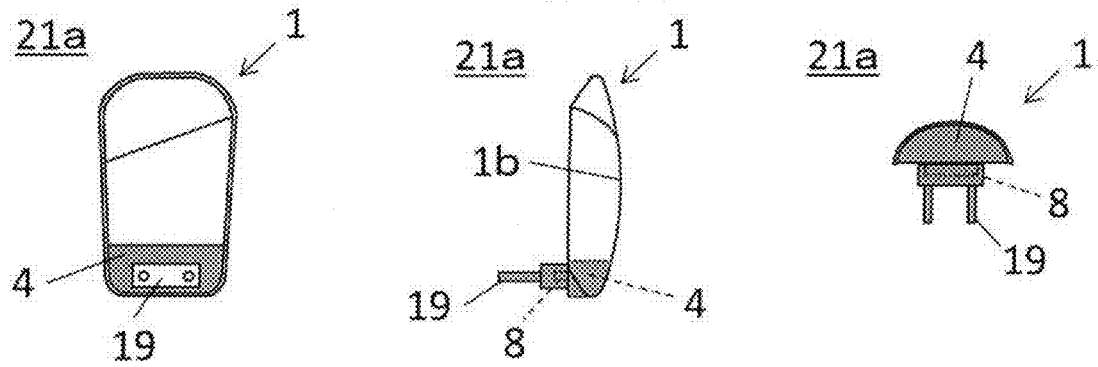
Figure 16C:
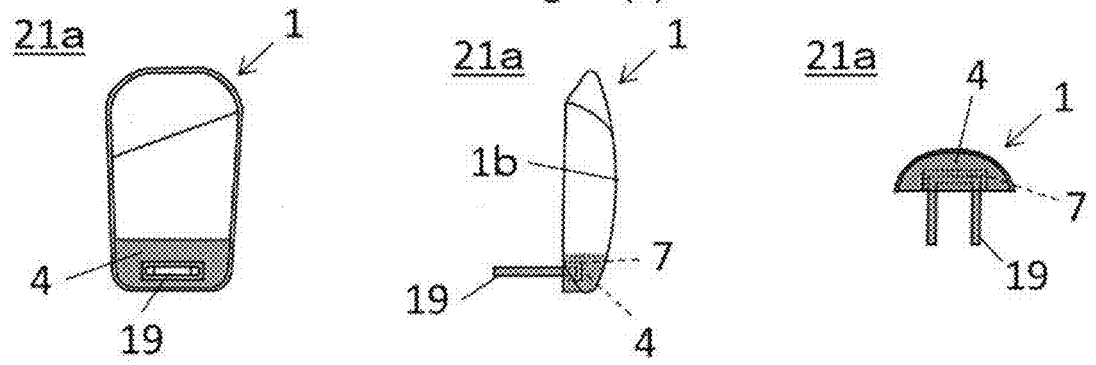
Figure 16D:
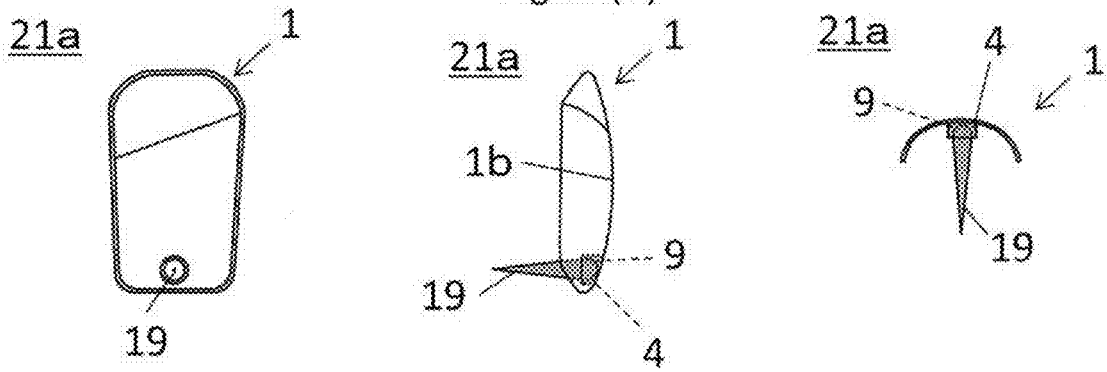

With reference to FIG. 10, a first embodiment of a nail tip positioning assistance tool according to the present invention will be described.

A nail tip positioning assistance tool 14*a* of the present embodiment is provided with an attachment assistance body 15 having a predetermined shape.

In each of the embodiments (first and second embodiments) of the nail tip positioning assistance tool, the attachment assistance body 15 can have one or more shapes, for example, selected from the group consisting of a rod-like shape, a plate-like shape, a columnar shape, a cylindrical shape, a spherical shape, a conic shape and a pyramid shape, and the like. In addition, the attachment assistance body 15 may have a convex-curved surface corresponding to the concavely curved surface 1*b* of the nail body 1. In an example shown in FIG. 10, the attachment assistance body 15 has a rectangular parallelepiped shape, and one end 16 thereof is convexly curved so as to correspond to the concavely curved surface 1*b* of the nail body 1.

One end 16 of the attachment assistance body 15 according to the present embodiment is attached to any one of:

(1) the thickness portion 3 of the nail body 1;
(2) the thick peripheral edge 1*h* of the peripheral edge of the nail body 1;
(3) the concavely curved surface 1*b* of the nail body 1;
(4) the base portion 4 arranged on the concavely curved surface 1*b* of the nail body 1; and
(5) the convexly curved surface 1*a* of the nail body 1.

In the example shown in FIG. 10, one end 16 of the attachment assistance body 15 is attached to the concavely curved surface 1*b* of the nail body 1.

The other end of the attachment assistance body includes the attachment for the attaching assistance member to be attached thereto. The attaching assistance member includes one or more members selected from the group consisting of the needle-like member, rod-like member, plate-like member, columnar member, cylindrical member, spherical member, conic member, pyramid member, adhesive member, magnet member, adsorption member, and hook member or loop member of hook and loop fastener.

In addition, the attachment according to the present embodiment includes any one of:

(1) the flat portion 5 for one end of the nail tip positioning assistance tool to be attached thereto;
(2) the projecting portion 8 or the recessed portion 7 for one end of the nail tip positioning assistance tool to be attached thereto;
(3) the hole 6 for one end of the nail tip positioning assistance tool to be inserted or screwed therein; and
(4) the engaged portion to be engaged with the engaging portion arranged on one end of the nail tip positioning assistance tool.

In an attachment assistance body 15 shown in FIG. 10 (*a*), the other end 17 thereof has the flat portion 5.

In an attachment assistance body 15 shown in FIG. 10 (*b*), the other end 17 thereof has the flat portion 5 and the hole 6.

In an attachment assistance body 15 shown in FIG. 10 (*c*), the other end 17 thereof has the flat portion 5 and the projecting portion 8.

In the hole 6 shown in FIG. 10 (*b*), the inner surface thereof may have the female screw portion. In addition, the outer surface of the projecting portion 8 shown in FIG. 10 (*c*) may have the male screw portion.

Various attaching assistance members 19 including those exemplified in FIG. 9 are attached to the attachment of the attachment assistance body 15 according to the present embodiment.

One end 12 of the attachment assistance member 19 shown in FIG. 9 which fits the flat portion 5 or the hole 6 is attached to the attachment assistance body shown in each of FIGS. 10(*a*) and 10(*b*) via an adhesive, gluing agent, or the like. In the case where the inner surface of the hole 6 shown in FIG. 10 (*b*) has the female screw portion, the male screw portion on one end 12 of the attaching assistance member 19 is screwed into the female screw portion.

The recessed portion or the hole placed on one end 12 of an attachment assistance member 19 other than members shown in FIG. 9 which fits the projecting portion 8 is attached to the attachment assistance body 15 shown in FIG. 10 (*c*) via the adhesive, gluing agent, or the like. In the case where the outer surface of the projecting portion 8 shown in FIG. 10 (*c*) has the male screw portion, the male screw portion is screwed into the female screw portion on one end 12 of the attachment assistance member 19.

In the case where the other end 17 of the attachment assistance body 15 shown in FIG. 10 has the fitting recess 9 as shown in FIG. 8(*a*), by freely fitting the spherical member on one end 12 of the attaching assistance member 19 to the fitting recess 9 as shown in FIGS. 9(*e*) and 9(*i*), the nail body 1 can be arranged to the nail tip display tool at various angles by adjusting the arrangement angle of the nail body 1 with respect to the nail tip display tool.

In each of the embodiments (first and second embodiments) of the nail tip positioning assistance tool, one end 16 of the attachment assistance body 15 is configured as a convex-curved surface 18 corresponding to the concavely curved surface 1*b* of the nail body 1 as shown in FIG. 10. Thus, the attachment assistance body 15 can be reliably attached to any portion of the concavely curved surface 1*b* of the nail body 1 and the nail body 1 can be arranged to the nail tip display tool at various angles by adjusting the arrangement angle of the nail body 1 with respect to the nail tip display tool.

In each of the embodiments (first and second embodiments) of the nail tip positioning assistance tool, the attachment assistance body 15 may be made of a well-known plastically deformable material. By the plastically deformable material, the nail body 1 can be arranged to the nail tip display tool at various angles by adjusting the arrangement angle of the nail body 1 with respect to the nail tip display tool.

Second Embodiment

With reference to FIGS. 11 and 12, a second embodiment of a nail tip positioning assistance tool according to the present invention will be described. The same reference numerals will be referred to the same elements of the first embodiment, and the description thereof will be omitted.

A nail tip positioning assistance tool 14*b* of the present embodiment includes the attachment assistance body 15 and various attaching assistance members 19 including the members illustrated in FIG. 9 attached to the attachment assistance body 15.

A method of attaching the attaching assistance member 19 to the attachment assistance body 15 may have various method such as a method of attaching to the attachment of the attachment assistance body 15, described in the above first embodiment, a method of integrally molding the attaching assistance member 19 with the attachment assistance body 15, and the like.

The nail tip positioning assistance tool 14*b* of the present embodiment may include a connector 20 connected to a plurality of the attachment assistance bodies 15, or the attachment assistance body 15 and the attachment assistance member 19.

In the nail tip positioning assistance tool 14*b* shown in each of FIGS. 11(*a*) to 11(*c*), one end 12 of the attaching assistance member 19 composed of the needle-like member shown in FIG. 9 (*a*) is attached to the other end 17 of the attachment assistance body 15.

In the nail tip positioning assistance tool 14*b* shown in each of FIG. 11 (*d*) to (*g*), the attachment assistance body 15 and the attaching assistance member 19 composed of the needle-like member shown in FIG. 9 (*a*) are connected to the connector 20.

In the nail tip positioning assistance tool 14*b* shown in FIG. 12, two attachment assistance bodies 15 are connected to the connector 20.

The attaching assistance member 19 can be detachably attached to the attachment assistance body 15 or the connector 20.

In the present embodiment, the connector 20 shown in each of FIGS. 11(*d*) to 11(*g*) and FIG. 12 may be made of the well-known plastically deformable material. By the plastically deformable material, the nail body 1 can be arranged to the nail tip display tool at various angles by adjusting the arrangement angle of the nail body 1 with respect to the nail tip display tool as shown in FIGS. 12(*b*) and 12(*c*).

The needle-like member, rod-like member, plate-like member, columnar member, cylindrical member, spherical member, conic member or pyramid member in the attaching assistance member 19 may be made of the known plastically deformable material. By the plastically deformable material, the nail body 1 can be arranged to the nail tip display tool at various angles by adjusting the arrangement angle of the nail body 1 with respect to the nail tip display tool as shown in FIG. 11 (*c*).

[Embodiment of Display Nail Tip]

First Embodiment

With reference to FIGS. 13 to 20, a first embodiment of a display nail tip according to the present invention will be described. The display nail tip of the present embodiment corresponds to the embodiment of the nail tip described above. The same reference numerals will be referred to the same elements of the nail tip, and the description thereof will be omitted.

The display nail tip 21*a* of the present embodiment includes the nail body 1, the nail tip positioning assistance tool for arranging the nail body 1 to the nail tip display tool such as the hard case, frame, board, pedestal, and the like, and the attachment for attaching to the nail tip positioning assistance tool.

As shown in FIGS. 13 to 19, the attachment according to this embodiment is arranged on any one of:

(1) the thickness portion 3 of the nail body 1;
(2) the thick peripheral edge 1*h* of the nail body 1;
(3) the concavely curved surface 1*b* of the nail body 1;
(4) the base portion 4 arranged on the concavely curved surface 1*b* of the nail body 1; and
(5) the convexly curved surface 1*a* of the nail body.

In addition, as shown in FIGS. 13 to 19, the attachment according to the present embodiment includes any one of:

(1) the flat portion 5 for one end of the nail tip positioning assistance tool to be attached thereto;
(2) the projecting portion 8 or the recessed portion 7 for one end of the nail tip positioning assistance tool to be attached thereto;
(3) the hole 6 for one end of the nail tip positioning assistance tool to be inserted or screwed therein; and
(4) the engaged portion to be engaged with the engaging portion arranged on one end of the nail tip positioning assistance tool.

In a display nail tip 21*a* shown in FIG. 13 (*a*), the thickness portion 3 of the nail body 1 has the flat portion 5. Five attaching assistance members 19 including needle-like bodies such as a split pin, insect pin, and the like shown in FIG. 9 (*a*) are attached to the flat portion 5.

In a display nail tip 21*a* shown in FIG. 13 (*b*), the thickness portion 3 of the nail body 1 has the flat portion 5 and two projecting portions 8. The attaching assistance member 19 is composed of the base portion of the plate-like member of FIG. 9 (*f*) on which five needle-like bodies in FIG. 9 (*a*) are arranged vertically. The base portion of the plate-like member has two holes corresponding to the projecting portions 8. The attaching assistance member 19 is attached to the nail body 1 by fitting the projecting portion 8 into the hole.

In a display nail tip 21*a* shown in FIG. 13 (*c*), the thickness portion 3 of the nail body 1 has the recessed portion 7. The attaching assistance member 19 is composed of the base portion of the plate-like member of FIG. 9 (*f*) in which five needle-like bodies in FIG. 9 (*a*) are provided upright. The attaching assistance member 19 is attached to the nail body 1 by fitting the plate-like member to the recessed portion 7.

In a display nail tip 21*a* shown in FIG. 13 (*d*), the attaching assistance member 19 is attached to the nail body 1 by fitting the plate-like member to the recessed portion 7 shown in FIG. 13 (*c*) via an adhesive member. Since the adhesive member is interposed, the attaching assistance member 19 can be detachably attached to the recessed portion 7.

In a display nail tip 21*a* shown in FIG. 14 (*a*), the thick peripheral edge 1*h* of the nail body 1 has the flat portion 5. The attaching assistance members 19 are attached to the flat portion 5. The attaching assistance member 19 is composed of a circular plate-like member on which a needle-like member shown in FIG. 9 (*a*) stands upright.

In a display nail tip 21*a* shown in FIG. 14 (*b*), the thick peripheral edge 1*h* of the nail body 1 has the projecting portion 8. The attaching assistance member 19 is composed of a cylindrical base portion on which the needle-like member shown in FIG. 9 (*a*) stands upright. The cylindrical base portion has the hole corresponding to the projecting portion 8. The attaching assistance member 19 is attached to the nail body 1 by fitting the projecting portion 8 into the hole.

In a display nail tip 21*a* shown in FIG. 14 (*c*), the thick peripheral edge 1*h* of the nail body 1 has the hole 6. The attaching assistance member 19 composed of a needle-like member shown in FIG. 9 (*a*) is attached to the hole 6.

In a display nail tip 21*a* shown in FIG. 14 (*d*), the thick peripheral edge 1*h* has an insertion hole 6*a* along the thickness portion 3 of the nail body 1. The attaching assistance member 19 composed of the needle like body shown in FIG. 9 (*a*) is inserted through the insertion hole 6*a*.

In a display nail tip 21*a* shown in FIG. 15(*a*), the attaching assistance member 19 shown in FIG. 9(*a*) is attached to the concavely curved surface 1*b* of the nail body 1. In a display nail tip 21*a* shown in FIG. 15(*b*), the attaching assistance member 19 shown in FIG. 9(*c*) is attached to the concavely curved surface 1*b* of the nail body 1. In a display nail tip 21*a* shown in FIG. 15(*c*), the attaching assistance member 19 shown in FIG. 9(*e*) is attached to the concavely curved surface 1*b* of the nail body 1.

In a display nail tip 21*a* shown in FIG. 15(*d*), the attaching assistance member 19 shown in FIG. 9 (*a*) bent along the concavely curved surface 1*b* is attached to the concavely curved surface 1*b* of the nail body 1.

In a display nail tip 21*a* shown in FIG. 16 (*a*), the concavely curved surface 1*b* of the nail body 1 has the base portion 4. The attaching assistance member 19 shown in FIG. 9 (*d*) is attached to the base portion 4.

In a display nail tip 21*a* shown in FIG. 16 (*b*), the concavely curved surface 1*b* of the nail body 1 has the base portion 4, and the base portion 4 has the projecting portion 8. The attaching assistance member 19 is composed of a rectangular base portion on which two needle-like bodies shown in FIG. 9 (*a*) stand upright. The rectangular base portion has the recessed portion corresponding to the projecting portion 8. The attaching assistance member 19 is attached to the nail body 1 by fitting the projecting portion 8 in the recessed portion.

In a display nail tip 21*a* shown in FIG. 16 (*c*), the concavely curved surface 1*b* of the nail body 1 has the base portion 4, and the base portion 4 has the recessed portion 7. The attaching assistance member 19 composed of a U-shaped needle like body shown in FIG. 9 (*c*) is attached to the recessed portion 7.

In a display nail tip 21*a* shown in FIG. 16 (*d*), the concavely curved surface 1*b* of the nail body 1 has the base portion 4, and the base portion 4 has the fitting recess 9. The attaching assistance member 19 being the conic-like member shown in FIG. 9 (*e*) is press-fitted into the fitting recess 9.

Figure 17:
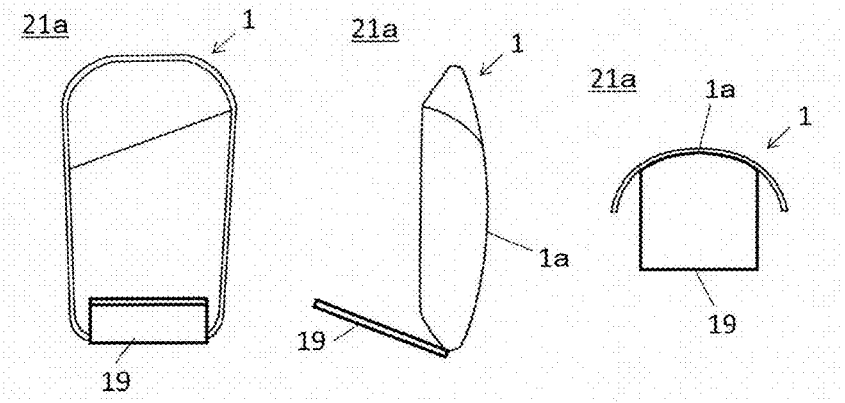
FIG. 17 shows a rear view, side view and bottom view in order from left, for yet another example of the display nail tip according to the first embodiment.
Figure 18A:
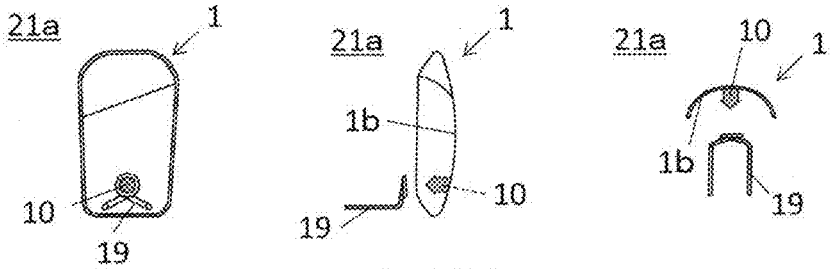
FIG. 18 (*a*) shows a rear view, side view and bottom view in order from left, for yet another example of the display nail tip according to the first embodiment.
Figure 18B:
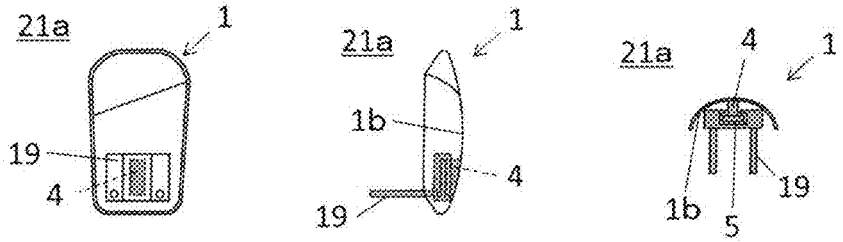
Figure 18C:
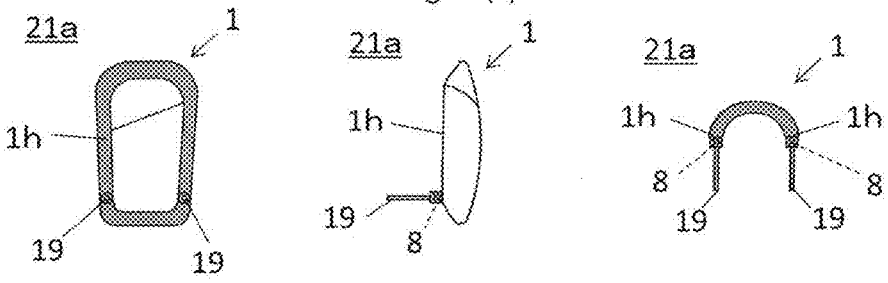
Figure 18D:
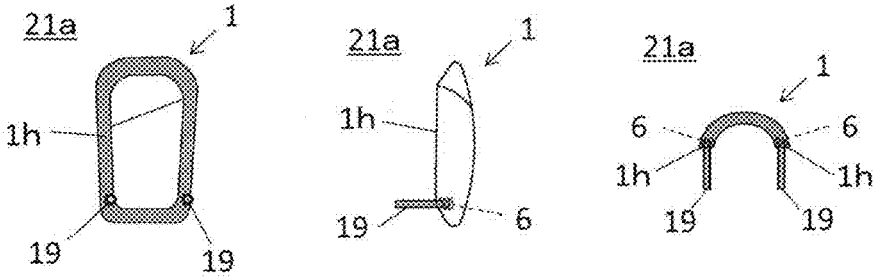

In a display nail tip 21*a* shown in FIG. 17, the attaching assistance member 19 shown in FIG. 9 (*f*) is attached to the convexly curved surface 1*a* of the nail body 1.

In a display nail tip 21*a* shown in FIG. 18 (*a*), the concavely curved surface 1*b* of the nail body 1 has the engaging projection 10. A needle-like attaching assistance member 19 having an annular portion is engaged with the engaging projection 10.

In a display nail tip 21*a* shown in FIG. 18 (*b*), the concavely curved surface 1*b* of the nail body 1 has the base portion 4, and the base portion 4 has the flat portion 5. The attaching assistance member 19 is composed of a rectangular base in which two needle-like bodies shown in FIG. 9(*a*) are arranged vertically. The rectangular base has the recessed portion corresponding to the flat portion 5. The attaching assistance member 19 is attached to the nail body 1 by fitting the concavely portion to the flat portion 5.

In a display nail tip 21*a* shown in FIG. 18 (*c*), the thick peripheral edge 1*h* of the nail body 1 has the projecting portions 8 having male screw portions. The attaching assistance member 19 is composed of a cylindrical base on which the needle-like member shown in FIG. 9 (*a*) is arranged vertically. The cylindrical base has the hole having a female screw portion corresponding to the male screw portion of the projecting portion 8. The attaching assistance member 19 is attached to the nail body 1 by screwing the male screw portion into the female screw portion.

In a display nail tip 21*a* shown in FIG. 18(*d*), the thick peripheral edge 1*h* of the nail body 1 has the holes 6 having the female screw portions. One end thereof is screwed into the female screw portion of the hole 6 has the attaching assistance member 19 composed of the needle-like member or the rod-like member having the male screw portion.

Figure 19A:
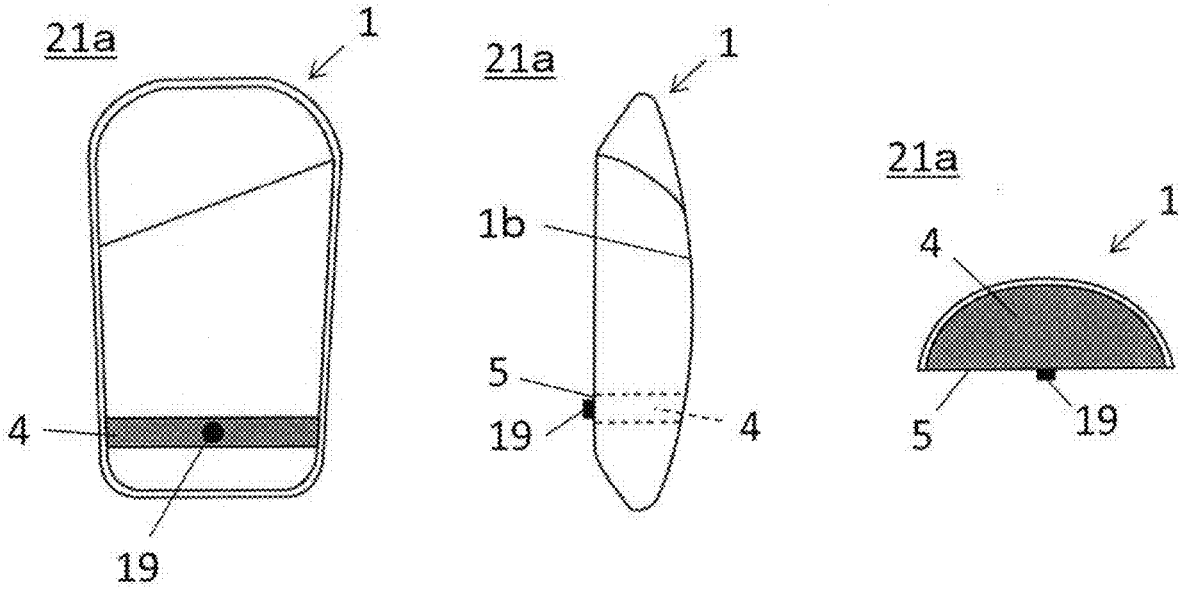
FIG. 19 (*a*) shows a rear view, side view and bottom view in order from left, for yet another example of the display nail tip according to the first embodiment.
Figure 19B:
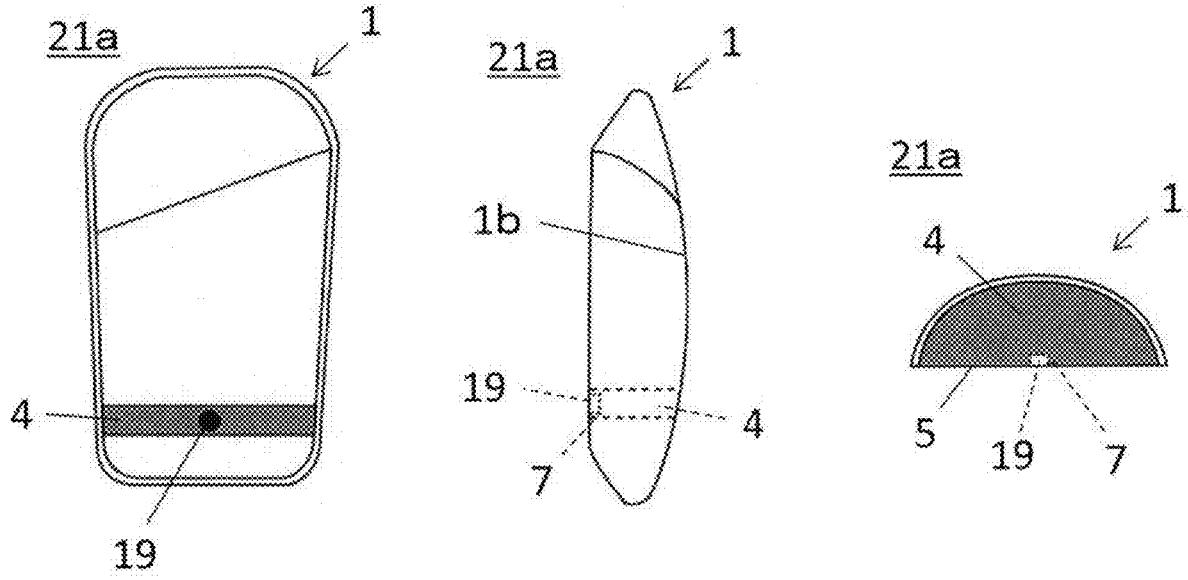
Figure 20A:
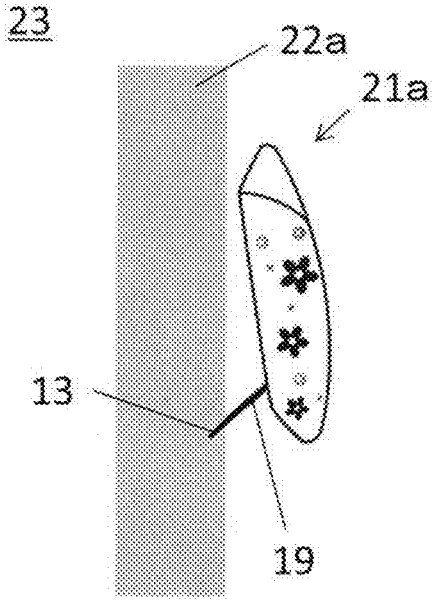
FIG. 20 (*a*) shows an example of a use state of the display nail tip according to the first embodiment.
Figure 20B:
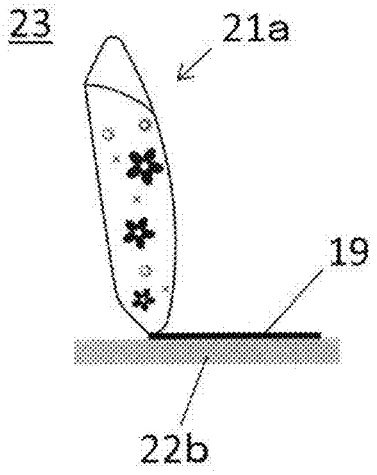
Figure 20C:
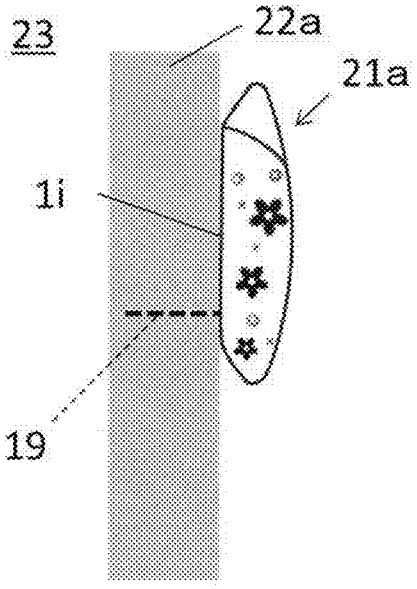
Figure 20D:
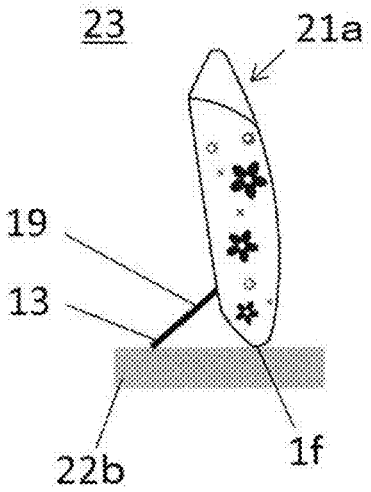

In a display nail tip 21*a* shown in FIG. 19 (*a*), the concavely curved surface 1*b* of the nail body 1 has the base portion 4, and the base portion 4 has the flat portion 5. The attaching assistance member 19 including the adhesive member, magnet and adsorption member such as the suction cup, or hook portion or loop portion of the surface fastener is attached to the flat portion 5.

In a display nail tip 21*a* shown in FIG. 19 (*b*), the concavely curved surface 1*b* of the nail body 1 has the base portion, and the base portion 4 has the recessed portion 7. The attaching assistance member 19 including the adhesive member, magnet and adsorption member such as the suction cup, or hook portion or loop portion of the surface fastener is attached to the recessed portion 7.

In each of the embodiments (first to third embodiments) of the display nail tip, the nail tip positioning assistance tool can be configured to be detachably attached to the attachment. In such configuration, the display nail tip can be adapted to the nail tip display tool such as the hard case, frame, board and pedestal by the combination of the nail body 1 having various attachments with the nail tip positioning assistance tool. In addition, even when the nail tip positioning assistance tool is broken, it is replaceable.

In each of the embodiments (first to third embodiments) of the display nail tip, the surface of the nail body 1 is divided into a decorative surface 1*c* and a non-decorative surface 1*d* being transparent. Therefore, when arranging the nail tip positioning assistance tool on the attachment of the nail body 1, it is preferable that the attachment is arranged on a place corresponding to the decorative surface 1*c*.

Depending on design applied to the nail body 1, the surface of the nail body 1 may be only the decorative surface 1*c*. In this case, since the non-decorative surface 1*d* being transparent does not exist, the position of the attachment having the nail tip positioning assistance tool can be freely selected.

In the present embodiment, in the molding of the display nail tip 21*a*, the display nail tip including the nail body 1 and the nail tip positioning assistance tool can be integral-molded with the nail body 1 and the nail tip positioning assistance tool or can be molded by inserting the nail tip positioning assistance tool into the attachment of the nail body 1.

In the integral-molding of the nail body 1 and the nail tip positioning assistance tool, the nail tip positioning assistance tool is arranged on any one of the thickness portion 3 of the nail body 1, the thick peripheral edge 1*h* of the nail body 1, the concavely curved surface 1*b* of the nail body 1, the base portion 4 arranged on the concavely curved surface 1*b* of the nail body 1 and the convexly curved surface 1*a* of the nail body 1.

In this case, the nail tip positioning assistance tool has one or more shapes selected from the group consisting of the needle-like shape, rod-like shape, plate-like shape, columnar shape, cylindrical shape, spherical shape, conic shape and pyramid shape.

In addition, the nail tip positioning assistance tool may be made of the well-known plastically deformable material. When the nail tip positioning assistance tool is molded from the plastically deformable material, the nail body 1 can be arranged at various angles on the nail tip display tool by adjusting the arrangement angle of the nail body 1 with respect to the nail tip display tool.

In the present embodiment, the base portion 4, the projecting portion 8 or the attaching assistance member 19 selected from the needle-like member, rod-like member, plate-like member, columnar member, cylindrical member, spherical member, conic member or pyramid member, may be molded from the known plastically deformable material. When the nail tip positioning assistance tool is molded from the plastically deformable material, the nail body 1 can be arranged at various angles on the nail tip display tool by adjusting the arrangement angle of the nail body 1 with respect to the nail tip display tool.

In the present embodiment, even when the spherical member of one end 12 of the attaching assistance member 19, shown in each of FIGS. 9(*e*) and 9(*i*), is freely fitted in the fitting recess 9 shown in FIG. 16(*d*), the nail body 1 can be arranged at various angles on the nail tip display tool by adjusting the arrangement angle of the nail body 1 with respect to the nail tip display tool.

In the present embodiment, when the nail body 1 is arranged on the nail tip display tool as described below, a nail tip sample set is produced.

(1) The other end of the nail tip positioning assistance tool is attached to or contacted with the nail tip display tool, and then the nail body 1 is set close to the nail tip display tool.

In an example shown in FIG. 20(*a*), the nail tip sample set 23 is configured such that the other end 13 of the attaching assistance member 19 is inserted into a cork board 22*a* and the nail body 1 is arranged close to the cork board 22*a*.

In addition, in an example shown in FIG. 20 (*b*), the nail tip sample set 23 is configured such that the attaching assistance member 19 is in contact with the pedestal 22*b* and the nail body 1 is arranged close to the pedestal 22*b*.

(2) The other end of the nail tip positioning assistance tool is attached to or contacted with the nail tip display tool, and then the front end portion 1*f*, the base end portion 1*e* (the rear end portion) or the side end portions 1*i* of the nail body 1 is contacted with the nail tip display tool.

In an example shown in FIG. 20(*c*), the nail tip sample set 23 is configured such that the attaching assistance member 19 is inserted into the cork board 22*a* and the side end portion 1*i* of the nail body 1 is arranged in contact with the cork board 22*a*.

In addition, in an example shown in FIG. 20(*d*), the nail tip sample set 23 is configured such that the other end 13 of the attaching assistance member 19 is contacted with the pedestal 22*b* and the front end portion 1*f* of the nail body 1 is arranged in contact with the pedestal 22*b*.

In this way, the display nail tip 21*a* of the present embodiment is displayed such that the nail tip positioning assistance tool including the attaching assistance member 19 arranged on the thickness portion 3, the thick peripheral edge 1*h*, the concavely curved surface 1*b*, the base portion 4 or the convexly curved surface 1*a* of the nail body 1 is attached to the nail tip display tool.

As shown in FIGS. 20(*a*) and 20(*c*), the nail tip positioning assistance tool is reliably attached to the nail tip display tool.

Therefore, the nail body 1 according to the present invention does not come off the nail tip display tool by an impact of breaking the arrangement of the nail tips 26 in a conventional nail tip sample set 24, and the arrangement of the display nail tip 21*a* can be maintained neatly.

In addition, since the nail tip positioning assistance tool can be removed from the nail tip display tool, the manicurist can easily change the arrangement of the display nail tips 21*a* and can effectively use a limited space in the nail salon and an area of the nail tip display tool.

In addition, when the nail tip for the nail art is attached to or detached from the customer's nail, dust resulting from filing the nail tip or the customer's nail hardly adheres to the nail tip exhibition tool. Therefore, maintenance such as cleaning of the nail tip sample set 23 is easy.

Alternatively, by providing the nail tip positioning assistance tool on the thickness portion 3, the thick peripheral edge 1*h*, the concavely curved surface 1*b*, the base portion 4 or the convexly curved surface 1*a* of the nail body 1, the display nail tip 21*a* can be displayed in a self-standing state on the nail tip display tool, and its posture can be maintained, as shown in FIGS. 20(*b*) and 20(*d*).

The conventional nail tip 26 cannot be displayed on the nail tip display tool in a self-standing state and can be arranged in a plane on the hard case, the frame, the board, the pedestal, or the like. Therefore, the displaying method of the nail tip 26 was limited to a planar one.

In the present embodiment, since the nail tip positioning assistance tool is arranged on the nail body 1 at various angles, as shown in FIG. 20, design applied to the surface of the nail body 1 by the above-described arrangement method can be displayed at various angles.

In addition, the base portion 4, the projecting portion 8 or the attaching assistance member 19 selected from the needle-like member, rod-like member, plate-like member, columnar member, cylindrical member, spherical member, conic member or pyramid member, may be molded from the plastically deformable material, and even when these optionally are modified, design applied to the surface of the nail body 1 can be displayed at various angles.

Furthermore, the design applied to the surface of the nail body 1 can be displayed at various angles by engaging the engaging portion with the engaged portion so as to adjust the arrangement angle of the nail body 1 with respect to the nail tip display tool (e.g., by freely fitting, in the fitting recess 9, the spherical member which is one end 12 of the attaching assistance member 19 as shown in FIGS. 9(*e*) and 9(*i*)), as shown in FIG. 16 (*d*).

Therefore, the customer never leans out while the customer is sitting, and it is possible to exhibit a sample nail tip 1 beautifully according to the viewing angle of the customer.

Second Embodiment

A second embodiment of the display nail tip according to the present invention will be described with reference to FIGS. 21 and 22. The display nail tip 21*b* of the present embodiment includes the attachment assistance body 15 related to the nail tip positioning assistance tool 14*a* of the first embodiment of the above-described nail tip positioning assistance tool, and the attaching assistance member 19 attached to the attachment assistance body 15. The same reference numerals will be referred to the same elements of the nail tip positioning assistance tool 14*a*, and the description thereof will be omitted.

Figure 21A:
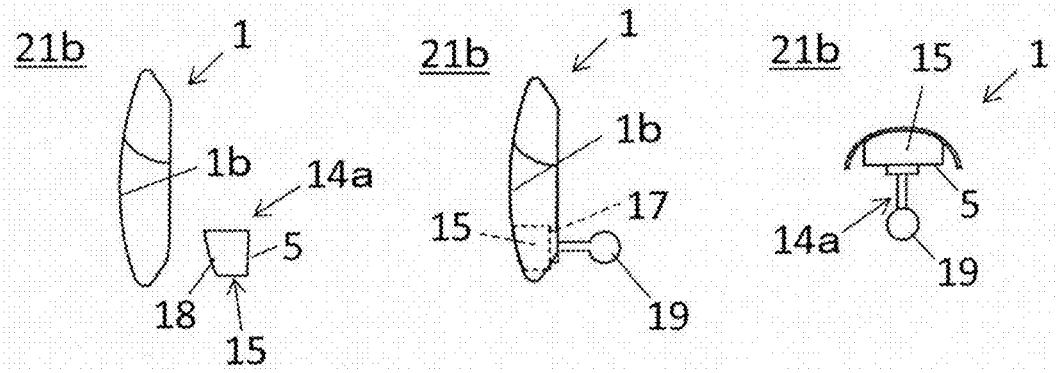
FIG. 21 (*a*) shows a side view, top view and bottom view in order from left, for an example of a second embodiment of a display nail tip according to the present invention.
Figure 21B:
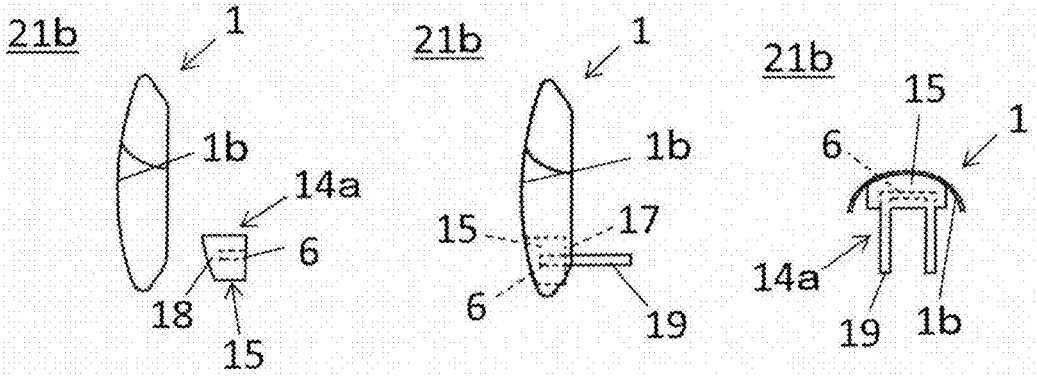
Figure 21C:
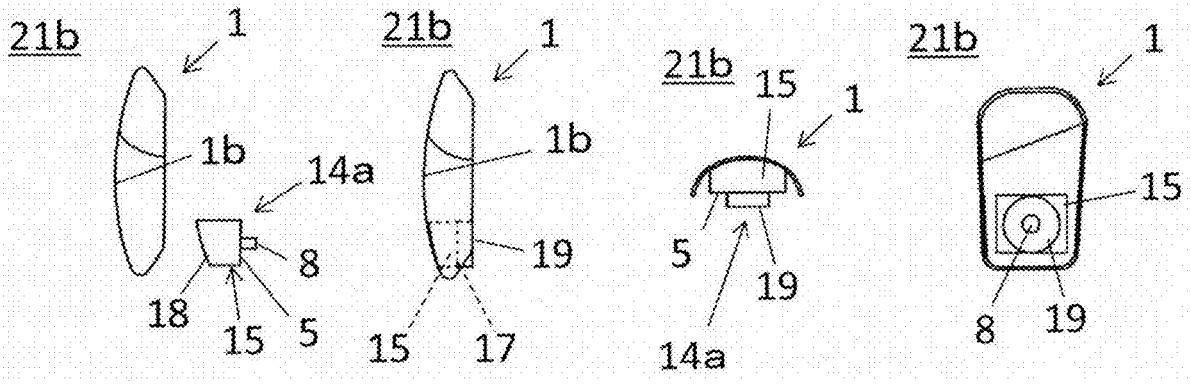
Figure 22A:
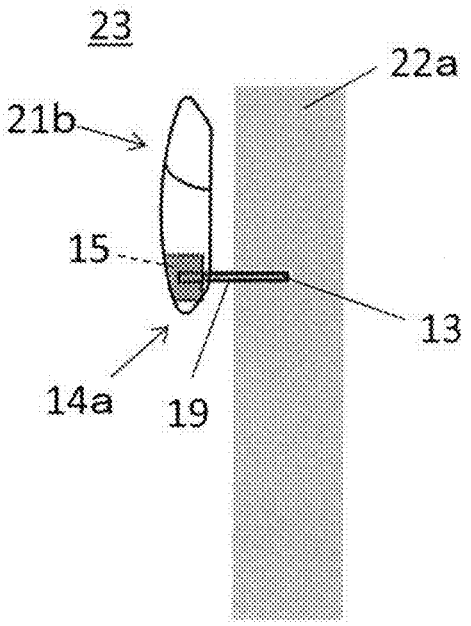
FIG. 22 (*a*) shows an example of a use state of the display nail tip according to the second embodiment.
Figure 22B:
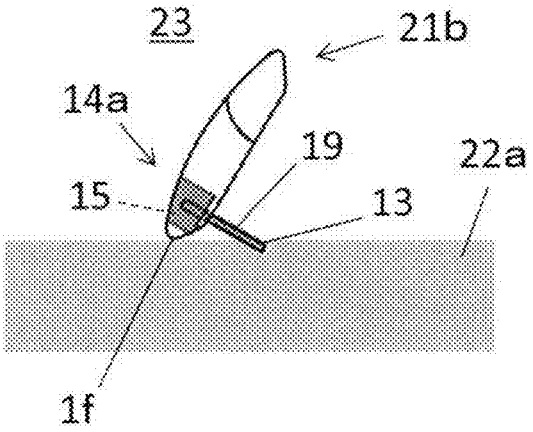
Figure 22C:
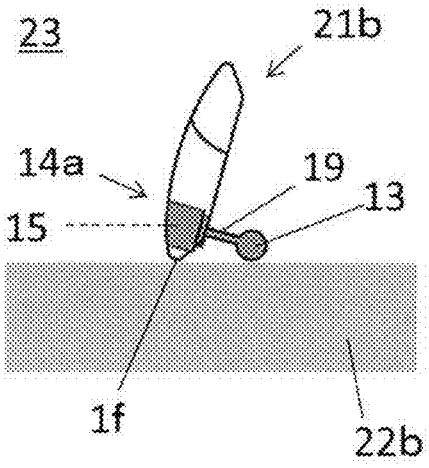
Figure 22D:
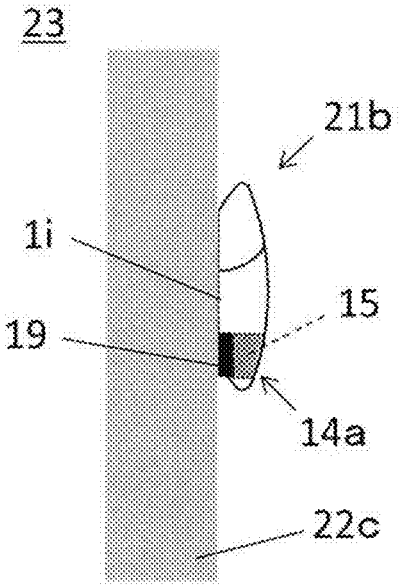
Figure 23A:
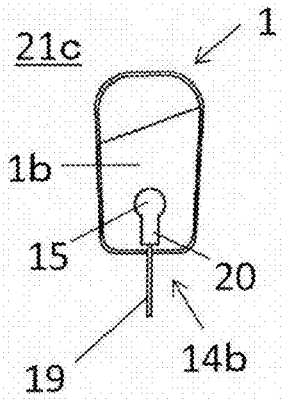
FIG. 23 (*a*) shows a rear view of a third embodiment of a display nail tip according to the present invention.
Figure 23B:
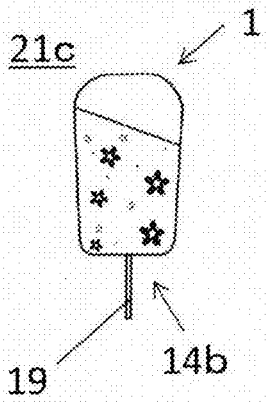
Figure 23C:
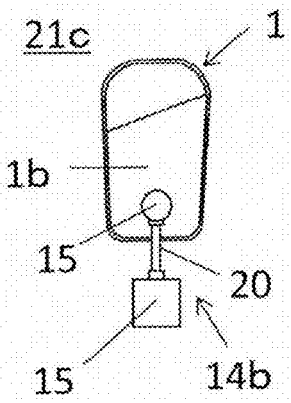
Figure 23D:
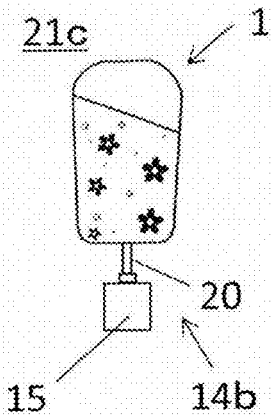
Figure 23E:
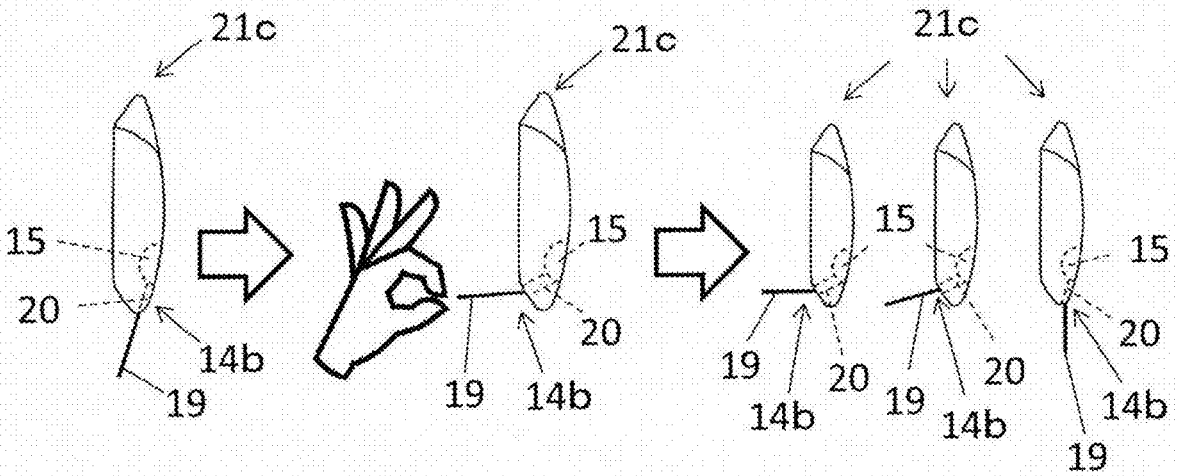
Figure 24A:
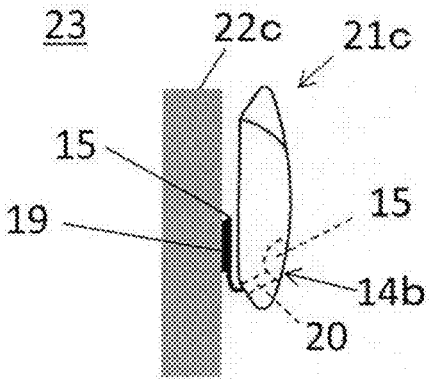
FIG. 24 (*a*) shows an example of a use state of the display nail tip according to the third embodiment.
Figure 24B:
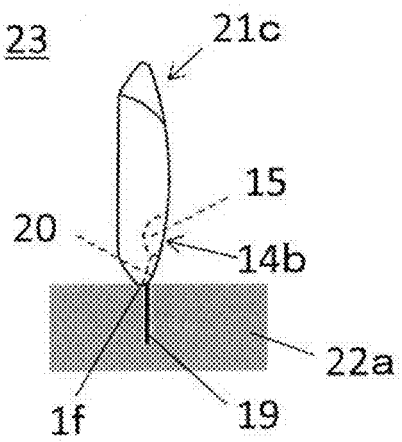
Figure 24C:
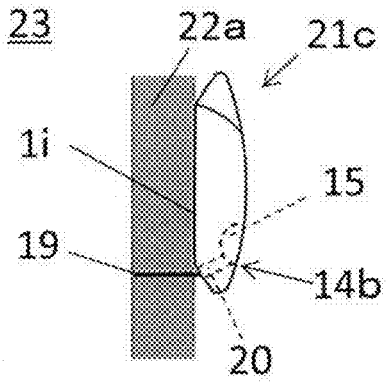
Figure 24D:
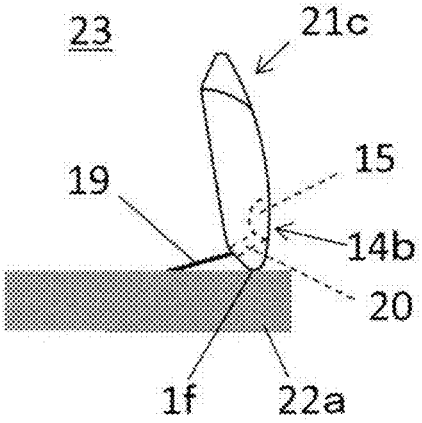
Figure 24E:
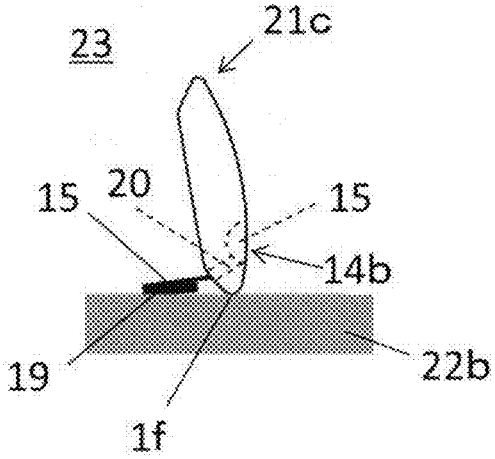
Figure 25:
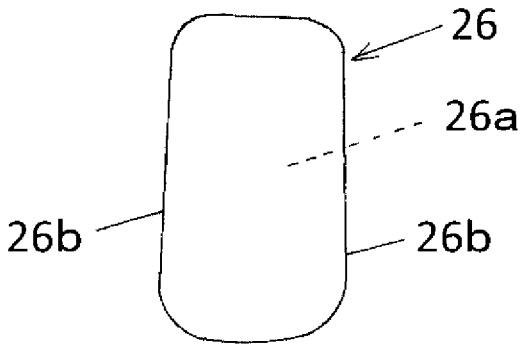
FIG. 25 (*a*) shows a front view of a conventional nail tip.
Figure 25:
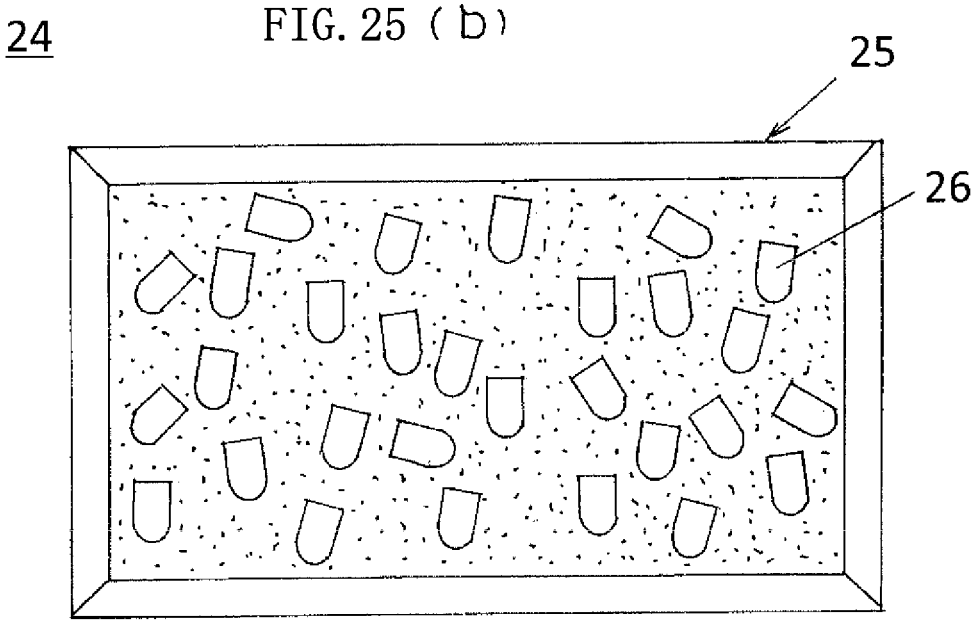

In a display nail tip 21*b* shown in each of FIGS. 21(*a*) to 21(*c*), the nail tip positioning assistance tool 14*a* including the attachment assistance body 15 having a convex-curved surface 18 corresponding to the concavely curved surface 1*b* of the nail body 1 is attached to the concavely curved surface 1*b* of the nail body 1.

In a display nail tip 21*b* shown in FIG. 21(*a*), the other end 17 of the attachment assistance body 15 has the flat portion 5. The attaching assistance member 19 configured such that the plate-shaped body is connected to the spherical member via a shaft is attached to the flat part 5.

In a display nail tip 21*b* shown in FIG. 21 (*b*), the other end 17 of the attachment assistance body 15 has the hole 6. The attaching assistance member 19 composed of a U-shaped needle-like member as shown in FIG. 9(*c*) is inserted in the hole 6.

In a display nail tip 21*b* shown in FIG. 21(*c*), the other end 17 of the attachment assistance body 15 has the flat portion 5 and projecting portion 8. The attaching assistance member 19 composed of an annular magnet plate having a hollow portion penetrating a center portion is fitted to the projecting portion 8.

In the present embodiment and a third embodiment to be described later, the attaching assistance member 19 can be configured to be detachably attached to the attachment assistance body 15. In such configuration, the display nail tip can be adapted to the nail tip display tool such as the hard case, frame, board and pedestal by the combination of the nail tip positioning assistance tool 14*a* including various attaching assistance members 19 and the attachment assistance body 15 with the nail tip 2. In addition, even when the nail tip positioning assistance tool is broken, it is replaceable.

In the present embodiment, in the molding of the display nail tip 21*b*, the display nail tip 21*b* including the nail body 1, the attachment assistance body 15 and the attaching assistance member 19 can be integral-molded with the nail body 1, the attachment assistance body 15 and the attaching assistance member 19 or can be molded by inserting the attaching assistance member 19 into the attachment assistance body 15.

In this embodiment and a third embodiment to be described later, the attachment assistance body 15 may be made of the well-known plastically deformable material. When the nail tip positioning assistance tool is molded from the plastically deformable material, the nail body 1 can be arranged at various angles on the nail tip display tool by adjusting the arrangement angle of the nail body 1 with respect to the nail tip display tool.

In the present embodiment and a third embodiment to be described later, the attachment assistance body 15 may have the convex-curved surface corresponding to the concavely curved surface 1*b* of the nail body 1. For example, with the other end 16 of the attachment assistance body 15 having a convexly curved shape, the attachment assistance body 15 can be reliably attached to any portion of the concavely curved surface 1*b* of the nail body 1 and the nail body 1 can be arranged to the nail tip display tool at various angles by adjusting the arrangement angle of the nail body 1 with respect to the nail tip display tool.

In the present embodiment, in the case where the other end 17 of the attachment assistance body 15 shown in FIG. 10 has the fitting recess 9, by freely fitting the spherical member on one end 12 of the attaching assistance member 19 to the fitting recess 9 as shown in FIGS. 9(*e*) and 9(*i*), the nail body 1 can be arranged to the nail tip display tool at various angles by adjusting the arrangement angle of the nail body 1 with respect to the nail tip display tool.

In the present embodiment, the projecting portion 8 or the attaching assistance member 19 selected from the needle-like member, rod-like member, plate-like member, columnar member, cylindrical member, spherical member, conic member or pyramid member may be made of the plastically deformable material, and even when these are modified, the nail body 1 can be arranged to the nail tip display tool at various angles by adjusting the arrangement angle of the nail body 1 with respect to the nail tip display tool.

In the present embodiment, when the nail body 1 is arranged on the nail tip display tool as described below, the nail tip sample set is produced.

(1) The other end of the nail tip positioning assistance tool 14*a* is attached to or contacted with the nail tip display tool, and then the nail body 1 is set close to the nail tip display tool.

In an example shown in FIG. 22(*a*), the nail tip sample set 23 is configured such that the other end 13 of the attaching assistance member 19 is inserted into the cork board 22*a* and the nail body 1 is arranged close to the cork board 22*a*.

(2) The other end of the nail tip positioning assistance tool 14*a* is attached to or contacted with the nail tip display tool, and then the front end portion 1*f*, the base end portion 1*e* (the rear end portion) or the side end portions 1*i* of the nail body 1 is contacted with the nail tip display tool.

In an example shown in FIG. 22(*b*), the nail tip sample set 23 is configured such that the attaching assistance member 19 is inserted into the cork board 22*a* and the front end portion 1*f* of the nail body 1 is arranged in contact with the cork board 22*a*.

In an example shown in FIG. 22(*c*), the nail tip sample set 23 is configured such that the other end 13 of the attaching assistance member 19 is contacted with the pedestal 22*b* and the front end portion 1*f* of the nail body 1 is arranged in contact with the pedestal 22*b*.

In an example shown in FIG. 22(*d*), the nail tip sample set 23 is configured such that the attaching assistance member 19 composed of an annular magnet plate is stuck to a metal board 22*c* and the side end portion 1*i* of the nail body 1 is arranged in contact with the metal board 22*c*.

In this way, the display nail tip 21*b* of the present embodiment is displayed such that the nail tip positioning assistance tool 14*a* arranged on the attachment assistance body 15 attached to the thickness portion 3, the thick peripheral edge 1*h*, the concavely curved surface 1*b*, the base portion 4 or the convexly curved surface 1*a* of the nail body 1 is attached to the nail tip display tool.

As shown in FIGS. 20(*a*), 20(*b*) and 20(*d*), the nail tip positioning assistance tool 14*a* is reliably attached to the nail tip display tool.

Therefore, the nail body 1 according to the present invention does not come off the nail tip display tool by an impact of breaking the arrangement of the nail tips in the conventional nail tip sample set 24, and the arrangement of the display nail tip 21*b* can be maintained neatly.

In addition, since the nail tip positioning assistance tool 14*a* can be removed from the nail tip display tool, the manicurist can easily change the arrangement of the display nail tips 21*b* and can effectively use a limited space in the nail salon and an area of the nail tip display tool.

In addition, when the nail tip for the nail art is attached to or detached from the customer's nail, dust resulting from filing the nail tip or the customer's nail hardly adheres to the nail tip display tool. Therefore, maintenance such as cleaning of the nail tip sample set 23 is easy.

Alternatively, by providing the nail tip positioning assistance tool 14*a* on the thickness portion 3, the thick peripheral edge 1*h*, the concavely curved surface 1*b*, the base portion 4 or the convexly curved surface 1*a* of the nail body 1, the display nail tip 21*b* can be displayed in a self-standing state on the nail tip display tool, and its posture can be maintained, as shown in FIGS. 22(*b*) and 22(*c*).

The conventional nail tip 26 cannot be displayed on the nail tip display tool in a self-standing state and can be arranged in a plane on the hard case, the frame, the board, the pedestal, or the like. Therefore, the displaying method of the nail tip 26 was limited to a planar one.

In the present embodiment, since the nail tip positioning assistance tool 14*a* is arranged on the nail body 1 at various angles, as shown in FIG. 22, design applied to the surface of the nail body 1 by the above-described arrangement method can be displayed at various angles.

In addition, the attachment assistance body 15, the projecting portion 8 or the attaching assistance member 19 selected from the needle-like member, rod-like member, plate-like member, columnar member, cylindrical member, spherical member, conic member or pyramid member, may be made of the plastically deformable material, and even when these optionally are modified, design applied to the surface of the nail body 1 can be displayed at various angles.

In addition, by the convexly curved surface 18 corresponding to the concavely curved surface 1*b* of the nail body 1 at one end 16 of the attachment assistance body 15, the attachment assistance body 15 can be reliably attached to any portion of the concavely curved surface 1*b* of the nail body 1 and design applied to the surface of the nail body 1 can be displayed at various angles by adjusting the arrangement angle of the nail body 1 with respect to the nail tip display tool.

Furthermore, the design applied to the surface of the nail body 1 can be displayed at various angles by engaging the engaging portion with the engaged portion so as to adjust the arrangement angle of the nail body 1 with respect to the nail tip display tool, e.g., by freely fitting, in the fitting recess 9, the spherical member which is one end 12 of the attaching assistance member 19 as shown in FIGS. 9(*e*) and 9(*i*) to the other end 17 of the attachment assistance body 15, as shown in FIG. 16 (*d*).

Therefore, it is possible to exhibit a sample nail tip 1 beautifully according to the viewing angle of the customer.

Third Embodiment

With reference to FIGS. 23 and 24, a third embodiment of the display nail tip according to the present invention will be described. The display nail tip 21*c* of the present embodiment includes the nail tip positioning assistance tool 14*b* according to the second embodiment of the above-described nail tip positioning assistance tool. The same reference numerals will be referred to the same elements of the nail tip positioning assistance tool 14*b*, and the description thereof will be omitted.

In a display nail tip 21*c* shown in each of FIGS. 23(*a*) and 23(*b*), the nail tip positioning assistance tool 14*b* shown in FIG. 11(*d*) is attached to the concavely curved surface 1*b* of the nail body 1.

In a display nail tip 21*c* shown in each of FIGS. 23(*c*) and 23(*d*), the nail tip positioning assistance tool 14*b* shown in FIG. 12(*e*) is attached to the concavely curved surface 1*b* of the nail body 1.

In this embodiment, the needle-like member, rod-like member, plate-like member, columnar member, cylindrical member, spherical member, conic member or pyramid member in the connector 20 or the attaching assistance member 19 of the nail tip placement assisting tool 14*b* may be made of the known plastically deformable material. By the plastically deformable material, the nail body 1 can be arranged to the nail tip display tool at various angles by adjusting the arrangement angle of the nail body 1 with respect to the nail tip display tool.

When the arrangement angle of the nail body 1 to the nail tip display tool is adjusted using the connector 20 or the attaching assistance member 19 made of the plastically deformable material, it is adjusted so as to be oriented in an appropriate direction such as a tangential direction and a normal direction of the back surface of the nail body 1 with the connector 20 or the attaching assistance member 19 adjusted with fingers, as shown in FIG. 23(*b*).

By the adjustment in this manner, the display nail tip 21*c* can be displayed according to various nail tip display tools.

In the present embodiment, when the nail body 1 is arranged on the nail tip display tool as described below, the nail tip sample set is produced.

(1) The other end of the nail tip positioning assistance tool 14*b* is attached to or contacted with the nail tip display tool, and then the nail body 1 is set close to the nail tip display tool.

In an example shown in FIG. 24(*a*), the connector 20 is deformed such that the attachment assistance body 15 on the other end is parallel to the attaching surface of the metal board 22*c*. The nail tip sample set 23 is configured such that the attaching assistance member 19 composed of the magnet affixed to the attachment assistance body 15 on the other end is stuck to the metal board 22*c*, and the nail body 1 is arranged close to the metal board 22*c*.

(2) The other end of the nail tip positioning assistance tool 14*b* is attached to or contacted with the nail tip display tool, and then the front end portion 1*f*, the base end portion 1*e* (the rear end portion) or the side end portions 1*i* of the nail body 1 is contacted with the nail tip display tool.

In an example shown in FIG. 24(*b*), the nail tip sample set 23 is configured such that the attaching assistance member 19 composed of the plastically deformable needle-like member is inserted into the cork board 22*a* and the front end portion 1*f* of the nail body 1 is arranged in contact with the cork board 22*a*.

In the example shown in FIG. 24(*c*), the attaching assistance member 19 composed of the plastically deformable needle-like member and the connector 20 made of the plastically deformable material are deformed and adjusted so as to be inserted into the cork board 22*a*. The nail tip sample set 23 is configured such that the attaching assistance member 19 is inserted into the cork board 22*a* and the side end portion 1*i* of the nail body 1 is arranged in contact with the cork board 22*a*.

In the example shown in FIG. 24(*d*), the attaching assistance member 19 composed of the plastically deformable needle-like member and the connector 20 made of the plastically deformable material are deformed and adjusted so as to be in contact with the cork board 22*a*. The nail tip sample set 23 is configured such that the attaching assistance member 19 is connected with the cork board 22*a* and the front end portion 1*f* of the nail body 1 is arranged in contact with the cork board 22*a*.

In an example shown in FIG. 24 (*e*), the connector 20 made of the plastically deformable material is deformed and the attachment assistance body 15 on the other end is adjusted so as to be able to contact with the pedestal 22*b*. The nail tip sample set 23 is configured such that the attaching assistance member 19 composed of the adhesive member affixed to the attachment assistance body 15 on the other end is attached to the pedestal 22*b* and the front end portion 1*f* of the nail body 1 is arranged in contact with the pedestal 22*b*.

In this way, the display nail tip 21*c* of the present embodiment is displayed such that the nail tip positioning assistance tool 14*a* attached to the thickness portion 3, the thick peripheral edge 1*h*, the concavely curved surface 1*b*, the base portion 4 or the convexly curved surface 1*a* of the nail body 1 is attached to the nail tip display tool.

As shown in FIGS. 24(*a*), 20(*b*) and 20(*c*), the nail tip positioning assistance tool 1*b* is reliably attached to the nail tip display tool.

Therefore, the nail body 1 according to the present invention does not come off the nail tip display tool by an impact of breaking the arrangement of the nail tips 26 in the conventional nail tip sample set 24, and the arrangement of the display nail tip 21*c* can be maintained neatly.

In addition, since the nail tip positioning assistance tool 14*b* can be removed from the nail tip display tool, the manicurist can easily change the arrangement of the display nail tips 21*c* and can effectively use a limited space in the nail salon and an area of the nail tip display tool.

In addition, when the nail tip for the nail art is attached to or detached from the customer's nail, dust resulting from filing the nail tip or the customer's nail hardly adheres to the nail tip exhibition tool. Therefore, maintenance such as cleaning of the nail tip sample set 23 is easy.

Alternatively, by providing the nail tip positioning assistance tool 14*b* on the thickness portion 3, the thick peripheral edge 1*h*, the concavely curved surface 1*b*, the base portion 4 or the convexly curved surface 1*a* of the nail body 1, the display nail tip 21*c* can be displayed in a self-standing state on the nail tip display tool, and its posture can be maintained, as shown in FIGS. 24(*b*), 24(*d*) and 22(*e*).

The conventional nail tip 26 cannot be displayed on the nail tip display tool in a self-standing state and can be arranged in a plane on the hard case, the frame, the board, the pedestal, or the like. Therefore, the displaying method of the nail tip 26 was limited to a planar one.

In the present embodiment, since the nail tip positioning assistance tool 14*b* is arranged on the nail body 1 at various angles with the connector 20 or the attaching assistance member 19 made of the plastically deformable material deformed, as shown in FIG. 24, design applied to the surface of the nail body 1 by the above-described arrangement method can be displayed at various angles.

In addition, the attachment assistance body 15, the projecting portion 8 or the attaching assistance member 19 selected from the needle-like member, rod-like member, plate-like member, columnar member, cylindrical member, spherical member, conic member or pyramid member may be made of the plastically deformable material, and even when these are optionally modified, design applied to the surface of the nail body 1 can be displayed at various angles.

In addition, by the convexly curved surface 18 corresponding to the concavely curved surface 1*b* of the nail body 1 at one end 16 of the attachment assistance body 15, the attachment assistance body 15 can be reliably attached to any portion of the concavely curved surface 1*b* of the nail body 1 and design applied to the surface of the nail body 1 can be displayed at various angles by adjusting the arrangement angle of the nail body 1 with respect to the nail tip display tool.

Furthermore, the design applied to the surface of the nail body 1 can be displayed at various angles by engaging the engaging portion with the engaged portion so as to adjust the arrangement angle of the nail body 1 with respect to the nail tip display tool, e.g., by freely fitting, in the fitting recess 9, the spherical member which is one end 12 of the attaching assistance member 19 as shown in FIGS. 9(*e*) and 9(*i*) to the other end 17 of the attachment assistance body 15, as shown in FIG. 16 (*d*).

Therefore, it is possible to exhibit a sample nail tip 1 beautifully according to the viewing angle of the customer.

Although the preferred embodiments of the present invention have been described above with reference to the accompanying drawings, the present invention is not limited to such embodiments, and various embodiments may be implemented within the technical scope ascertained from the description of the claims.

LETTERS OR NUMERALS

1 Nail body
1*a* Convexly curved surface
1*b* Concavely curved surface
1*c* Decorative surface
1*d* Non-decorative surface
1*e* Base end portion of nail body
1*f* Front end portion of nail body
1*g* Peripheral edge of nail body
1*h* Thick peripheral edge
1*i* Side end portion of nail body
2 Nail tip
3 Thickness portion of nail body
4 Base portion
5 Flat portion
6 Hole
7 Recessed portion
8 Projecting portion
9 Fitting recess
10 Engaging projection
11 Engaging groove
12 One end of attaching assistance member
13 Other end of attaching assistance member
14*a*, 14*b* Nail tip positioning assistance tool
15 Attachment assistance body
16 One end of attachment assistance body
17 Other end of attachment assistance body
18 Convex-curved surface
19 Attaching assistance member
20 Connector
21*a*, 21*b*, 21*c* Display nail tip
22*a* Cork board
22*b* Pedestal
22*c* Metal board
23 Nail tip sample set
24 Conventional nail tip sample set
25 Nail tip display tool
26 Conventional nail tip
26*a* Back surface
26*b* Peripheral edge

What is claimed is:

1. A nail tip comprising:

(1) a nail body having a convexly curved outer surface, a concavely curved back surface, a peripheral edge, and a concavity defined by the concavely curved back surface and the peripheral edge which circumferences the concavity;

(2) wherein the nail body comprises any one of:

(a) a thickness portion entirely filling the concavity and having an outer surface formed flush with the peripheral edge of the nail body at the same level;

(b) a thickness portion entirely filling the concavity and having an outer surface arranged so as to extend beyond the peripheral edge of the nail body;

(c) a thickness portion entirely filling the concavity and having an outer surface arranged so that a thickness of a front end portion of the nail body is thicker than that of a base end portion of the nail body;

(d) a thickness portion entirely filling the concavity and having an outer surface arranged so that the thickness of the base end portion of the nail body is thicker than that of the front end portion of the nail body;

(e) a base portion partially filling the concavity and having a convexly curved surface abutting and complementary to at least a portion of the concavely curved back surface of the nail body;

(f) a thick peripheral edge, circumferencing the concavity, having a thickness greater than the peripheral edge of the nail body;

(3) a nail tip positioning assistance tool;

(4) wherein the nail tip positioning assistance tool is arranged on any one of:

(a) the thickness portion of the nail body;

(b) the thick peripheral edge of the nail body;

(c) the concavely curved surface of the nail body;

(d) the base portion of the nail body;

(e) the convexly curved surface of the nail body;

(5) wherein the part of the nail body on which the nail tip positioning assistance tool is arranged comprises any one of:
(a) a flat portion for one end of the nail tip positioning assistance tool to be attached thereto;
(b) a projecting portion or a recessed portion for one end of the nail tip positioning assistance tool to be attached thereto;
(c) a hole for one end of the nail tip positioning assistance tool to be inserted or screwed therein;
(d) an engaged portion to be engaged with an engaging member arranged on one end of the nail tip positioning assistance tool; and
(6) wherein the engaging member is fitted freely with the engaged portion.

2. A nail tip, comprising:
(1) a nail body having a convexly curved outer surface, a concavely curved back surface, a peripheral edge, and a concavity defined by the concavely curved back surface and the peripheral edge which circumferences the concavity;
(2) wherein the nail body comprises any one of:
(a) a thickness portion entirely filling the concavity and having an outer surface formed flush with the peripheral edge of the nail body at the same level;
(b) a thickness portion entirely filling the concavity and having an outer surface arranged so as to extend beyond the peripheral edge of the nail body;
(c) a thickness portion entirely filling the concavity and having an outer surface arranged so that a thickness of a front end portion of the nail body is thicker than that of a base end portion of the nail body;
(d) a thickness portion entirely filling the concavity and having an outer surface arranged so that the thickness of the base end portion of the nail body is thicker than that of the front end portion of the nail body;
(e) a base portion partially filling the concavity and having a convexly curved surface abutting and complementary to at least a portion of the concavely curved back surface of the nail body;
(f) a thick peripheral edge, circumferencing the concavity, having a thickness greater than the peripheral edge of the nail body;
(3) a nail tip positioning assistance tool;
(4) wherein the nail tip positioning assistance tool is arranged on any one of:
(a) the thickness portion of the nail body;
(b) the thick peripheral edge of the nail body;
(c) the concavely curved surface of the nail body;
(d) the base portion of the nail body;
(e) the convexly curved surface of the nail body;
(5) wherein the nail tip positioning assistance tool is detachably attached to the nail body.

3. A nail tip, comprising:
(1) a nail body having a convexly curved outer surface, a concavely curved back surface, a peripheral edge, and a concavity defined by the concavely curved back surface and the peripheral edge which circumferences the concavity;
(2) wherein the nail body comprises any one of:
(a) a thickness portion entirely filling the concavity and having an outer surface formed flush with the peripheral edge of the nail body at the same level;
(b) a thickness portion entirely filling the concavity and having an outer surface arranged so as to extend beyond the peripheral edge of the nail body;
(c) a thickness portion entirely filling the concavity and having an outer surface arranged so that a thickness of a front end portion of the nail body is thicker than that of a base end portion of the nail body;
(d) a thickness portion entirely filling the concavity and having an outer surface arranged so that the thickness of the base end portion of the nail body is thicker than that of the front end portion of the nail body;
(e) a base portion partially filling the concavity and having a convexly curved surface abutting and complementary to at least a portion of the concavely curved back surface of the nail body;
(f) a thick peripheral edge, circumferencing the concavity, having a thickness greater than the peripheral edge of the nail body;
(3) a nail tip positioning assistance tool;
(4) wherein the nail tip positioning assistance tool is arranged on any one of:
(a) the thickness portion of the nail body;
(b) the thick peripheral edge of the nail body;
(c) the concavely curved surface of the nail body;
(d) the base portion of the nail body;
(e) the convexly curved surface of the nail body;
(5) wherein the nail tip positioning assistance tool comprises:
(a) an attachment assistance body; and
(b) an attaching assistance member to be attached to the attachment assistance body.

4. The nail tip according to claim 3, comprising a connector connected to a plurality of the attachment assistance bodies or the attachment assistance body and the attaching assistance member.

5. The nail tip according to claim 4, wherein the connector is made of a plastically deformable material.

6. The nail tip according to claim 4, wherein the attaching assistance member is detachably attached to the connector.

7. The nail tip according to claim 3, wherein the attaching assistance member is detachably attached to the attachment assistance body.

8. The nail tip according to claim 3, the attachment assistance body has one or more shapes selected from the group consisting of a rod shape, a plate shape, a columnar shape, a cylindrical shape, a spherical shape, a conic shape and a pyramid shape.

9. The nail tip according to claim 8, the attachment assistance body is made of a plastically deformable material.

10. The nail tip according to claim 8, wherein the attachment assistance body has a convex-curved surface corresponding to a concavely curved surface of the nail body.

11. The nail tip according to claim 3, wherein the attaching assistance member comprises one or more members selected from the group consisting of a needle member, rod member, plate member, columnar member, cylindrical member, spherical member, conic member, pyramid member, adhesive member, magnet member, adsorption member, and hook member or loop member of hook and loop fastener.

12. The nail tip according to claim 11, wherein the needle member, rod member, plate member, columnar member, cylindrical member, spherical member, conic member and pyramid member is made of a plastically deformable material.

* * * * *